US006170177B1

(12) United States Patent
Frappier et al.

(10) Patent No.: US 6,170,177 B1
(45) Date of Patent: Jan. 9, 2001

(54) FOOTWEAR CUSTOMIZATION SYSTEM AND PROCESS

(76) Inventors: John P. Frappier, 1005 18th Ave. South, Horace, ND (US) 58047; Stephen C. Swanson, 150 Lower Evergreen Dr., Park City, UT (US) 84098

( * ) Notice: Under 35 U.S.C. 154(b), the term of this patent shall be extended for 0 days.

(21) Appl. No.: 09/276,581

(22) Filed: Mar. 25, 1999

Related U.S. Application Data

(60) Provisional application No. 60/115,578, filed on Jan. 12, 1999, and provisional application No. 60/102,070, filed on Sep. 28, 1998.

(51) Int. Cl.[7] ..... A43D 1/02; B29D 31/50

(52) U.S. Cl. ..... 36/142 R; 12/21; 12/146 B; 12/146 BR; 12/146 M; 33/515

(58) Field of Search ..... 12/21, 142 R, 12/142 P, 146 B, 146 BR, 146 M, 38; 33/515, 512

(56) References Cited

U.S. PATENT DOCUMENTS

| | | | | |
|---|---|---|---|---|
| D. 328,159 | | 7/1992 | Donzis | D29/10 |
| 2,743,483 | * | 5/1956 | Parini . | |
| 4,062,355 | | 12/1977 | Kaye | 128/2 S |
| 4,217,705 | | 8/1980 | Donzis | 36/29 |
| 4,370,754 | | 2/1983 | Donzis | 2/22 |
| 4,441,211 | | 4/1984 | Donzis | 2/2 |
| 4,453,271 | | 6/1984 | Donzis | 2/2 |
| 4,486,901 | | 12/1984 | Donzis | 2/2 |
| 4,513,449 | | 4/1985 | Donzis | 2/2 |
| 4,716,662 | * | 1/1988 | Bar . | |
| 4,874,640 | | 10/1989 | Donzis | 427/421 |
| 4,876,758 | * | 10/1989 | Rolloff et al. . | |
| 4,901,390 | * | 2/1990 | Daley . | |
| 5,027,461 | * | 7/1991 | Cumberland . | |
| 5,203,793 | | 4/1993 | Lyden | 36/88 |
| 5,228,454 | | 7/1993 | Siegler | 128/782 |
| 5,235,715 | | 8/1993 | Donzis | 12/142 R |
| 5,638,612 | | 6/1997 | Donzis | 36/29 |
| 5,687,467 | * | 11/1997 | Bergamnn et al. . | |
| 5,689,849 | * | 11/1997 | Charles . | |
| 5,794,275 | | 8/1998 | Donzis | 2/455 |
| 5,881,395 | | 3/1999 | Donzis | 2/455 |
| 5,890,248 | * | 4/1999 | Gee . | |
| 6,000,082 | * | 12/1999 | Nguyen . | |
| 6,026,595 | * | 2/2000 | Curry . | |

FOREIGN PATENT DOCUMENTS

| | | |
|---|---|---|
| 3835008 | 10/1988 | (DE) . |
| 2312754 | 4/1996 | (GB) . |

* cited by examiner

*Primary Examiner*—Ted Kavanaugh
(74) *Attorney, Agent, or Firm*—Faegre & Benson LLP

(57) ABSTRACT

A footwear customization system that includes a rearfoot and forefoot goniometer for measuring rearfoot and forefoot alignment of a foot to provide rearfoot and forefoot alignment data. A customizable piece of footwear having a moldable, settable midsole is mounted on a shoe press, and the shoe press applies pressure to the midsole based on the rearfoot and forefoot alignment data in order to form a contour in the midsole. The contour provides alignment corrections based on the rearfoot and forefoot alignment data. A computer running a footwear customization program can be interfaced to the rearfoot and forefoot goniometer and the shoe press to receive the rearfoot and forefoot alignment data from the rearfoot and forefoot goniometer and provide it to the shoe press. An injection apparatus can be used to set the midsole of the piece of footwear so that the midsole retains the contour after the piece of footwear has been removed from the shoe press. Preferably, the rearfoot and forefoot alignment of the foot is measured while the foot is in a non-weight bearing position known as sub-talar neutral.

8 Claims, 18 Drawing Sheets

FOOTWEAR CUSTOMIZATION SYSTEM AND PROCESS

REFERENCE TO RELATED APPLICATION

This application claims the benefit of U.S. Provisional Patent Application Ser. No. 60/115,578 filed on Jan. 12, 1999, and U.S. Provisional Patent Application Ser. No. 60/102,070 filed on Sep. 28, 1998.

TECHNICAL FIELD

The present invention relates generally to footwear customization systems and processes. In particular, the present invention relates to a system and process of customizing a piece of footwear based on rearfoot and forefoot alignment measurements.

BACKGROUND OF THE INVENTION

A large percentage of the general population in the United States exhibits some sort of misalignment of the foot, either in the rearfoot, forefoot, or both. If uncorrected, these misalignment characteristics can manifest themselves as overuse injuries of the lower extremity, fatigue, or abnormal wear of the shoes.

Those with severe misalignment often seek the assistance of a professional (such as a podiatrist or therapist) who typically prescribes a corrective orthotic. This process is usually effective, if a careful assessment of the patient's foot alignment characteristics is taken. However, this process is expensive and results in a prosthesis that must be inserted on top of or in place of the insole of the shoe. Also, the precise correction that is incorporated into most orthotics may be necessary in only some patients with severe misalignment problems. However, most patients with only minor misalignments could benefit from a general correction. This general correction of any misalignment may provide a substantial benefit in terms of comfort, performance, and wear of a shoe (or other piece of footwear) for anyone who exhibits any kind of foot misalignment.

Professionals typically use a conventional hand-held goniometer to make alignment assessments of the rearfoot and forefoot for prescription of orthoses. Thus, only one hand can be used to correctly position the hand-held goniometer during the assessment. This introduces the potential for measurement errors during the assessment.

There is a need, therefore, for an improved footwear customization system and process.

SUMMARY OF THE INVENTION

A footwear customization process according to the present invention includes measuring alignment of a foot to provide alignment data and providing a piece of footwear having a moldable, settable midsole. The process also includes applying pressure to the midsole based on the alignment data to form a contour in the midsole that provides alignment corrections based on the alignment data. Preferably, rearfoot and forefoot alignment of the foot is measured while the foot is in a non-weight bearing position known as sub-talar neutral in order to provide rearfoot and forefoot alignment data. The process of the present invention can further include setting the midsole so that the midsole resiliently retains the shape of the contour after the pressure is removed.

The present invention also relates to a system for customizing a piece of footwear having a moldable, settable midsole. The system according to present invention comprises a rearfoot and forefoot goniometer for measuring rearfoot and forefoot alignment of a foot to provide rearfoot and forefoot alignment data. The system also includes a press operatively coupled to the rearfoot and forefoot goniometer to receive the rearfoot and forefoot alignment data for forming a contour in the midsole that provides alignment corrections based on the rearfoot and forefoot alignment data. In addition, the system can include a computer that receives the rearfoot and forefoot alignment data from the rearfoot and forefoot goniometer, stores the rearfoot and forefoot alignment data in a customer database within the computer, and provides the rearfoot and forefoot alignment data to the shoe press. The system can also include an injection apparatus for injecting an additive or other fluid into the midsole of the customizable shoe in order to set the midsole. Preferably, the rearfoot and forefoot goniometer allows the rearfoot and forefoot alignment of the foot to be measured while the foot is in a non-weight bearing position known as sub-talar neutral.

DETAILED DESCRIPTION OF THE INVENTION

Figure 1:
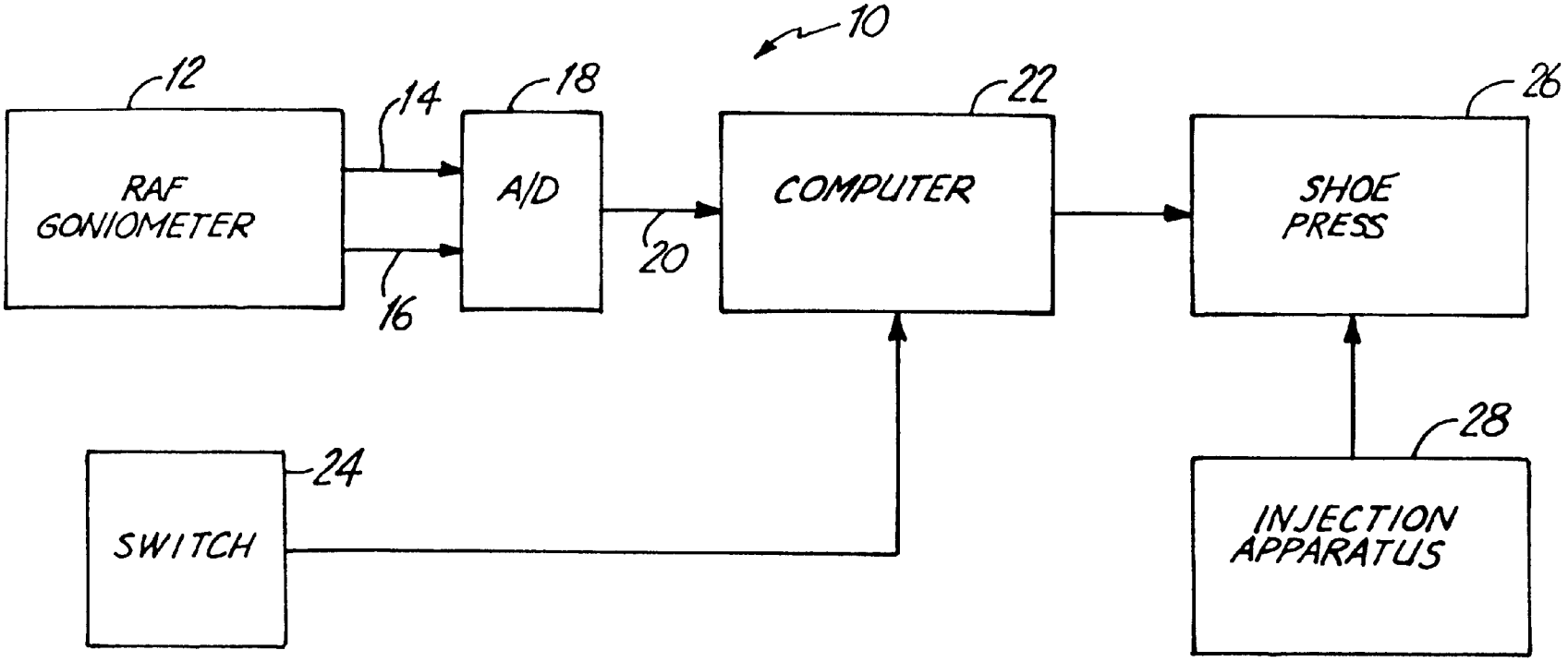
FIG. 1 is a block diagram of a footwear customization system according to the present invention.

A block diagram of a footwear customization system 10 according to the present invention is shown in FIG. 1. The alignment characteristics of a customer's foot (not shown in FIG. 1) are assessed using a rearfoot and forefoot ("RAF") goniometer 12. Preferably, the alignment characteristics of both of the customer's feet are assessed using the RAF goniometer 12. The RAF goniometer 12 allows a technician to obtain an accurate and repeatable non-weight bearing assessment of rearfoot and forefoot alignment of a customer's foot. Once the foot is properly positioned in the RAF goniometer 12, rearfoot and forefoot alignment sensors (goniometers) (not shown in FIG. 1) make an accurate (preferably, less than 1 degree error) alignment assessment when the technician closes a switch 24. One advantage of the RAF goniometer 12 of the present invention is that both of the technician's hands are free to correctly position the foot during the assessment.

Analog signals 14 and 16 from the rearfoot and forefoot goniometers are interfaced to a conventional analog-to-digital ("A/D") converter 18, which provides an output signal 20 that is a digital representation of the analog signals 14 and 16. The output signal 20 is interfaced to a preprogrammed general-purpose computer 22. It is to be understood, however, that digital rearfoot and forefoot goniometers can be used with present invention, in which case A/D converter 18 would not be needed and the signals from the digital rearfoot and forefoot goniometer could be directly interfaced to computer 22. The computer 22 runs a footwear customization program (described in more detail below) that allows the rearfoot and forefoot alignment data from the RAF goniometer 12 to be displayed on the monitor of the computer 22 and saved into a customer database within the computer 22 when the switch 24 (preferably a foot operated switch) is closed. The computer 22 is interfaced to a shoe press 26 so that the rearfoot and forefoot alignment data can be sent to the shoe press 26 to customize a customizable shoe (not shown in FIG. 1), or other piece of customizable footwear, that has been mounted on the shoe press 26. It is to be understood, however, that the output signal 20 can be interfaced directly to the shoes press 26 with appropriate interface hardware and/or software.

The customizable shoe has a moldable, settable midsole, for example, having two bladders incorporated into the midsole of the shoe. The customizable shoe is designed and manufactured to be both customizable by the system 10 and to meet the other design requirements of the shoe manufacturer.

The shoe press 26 applies pressure to the midsole of the shoe to form a contour in the midsole that provides alignment corrections based on the rearfoot and forefoot alignment data measured by the RAF goniometer 12. Then the midsole of the shoe is set, for example, by an injection apparatus 28 that injects a settable fluid, such as polyurethane or EVA (ethyl vinyl acetate) foam, of a specified density and hardness into the bladders within the midsole of the shoe. The foam filling the bladders is shaped in the manner imposed by the shoe press 26 and has the proper material characteristics as specified by the shoe manufacturer. Thus, the alignment correction is incorporated into the midsole of the shoes, thereby customizing the midsole of the shoes. The whole process (alignment assessment and shoe customization) typically takes about 15–20 minutes. The footwear customization process and system of the present invention is preferably used in a retail setting, although the system 10 (or any part thereof such as the RAF goniometer 12) can be used in professional or other settings.

One embodiment of a RAF goniometer 12 according to the present invention is shown in FIGS. 2–7. The RAF goniometer 12 is mounted on a padded table 30 (which is only partially shown in FIG. 2) and comprises a rearfoot goniometer apparatus 32 and a forefoot goniometer apparatus 34. The rearfoot goniometer apparatus 32 and the forefoot goniometer apparatus 34 are attached to rearfoot and forefoot attachment interfaces 36 and 38, respectively, both of which have an inverted U shape. The rearfoot attachment interface 36 extends from a support enclosure 40 via a pair of rearfoot telescopic uprights 42, and the forefoot attachment interface 38 extends from a pair of forefoot telescopic uprights 44.

Figure 2:
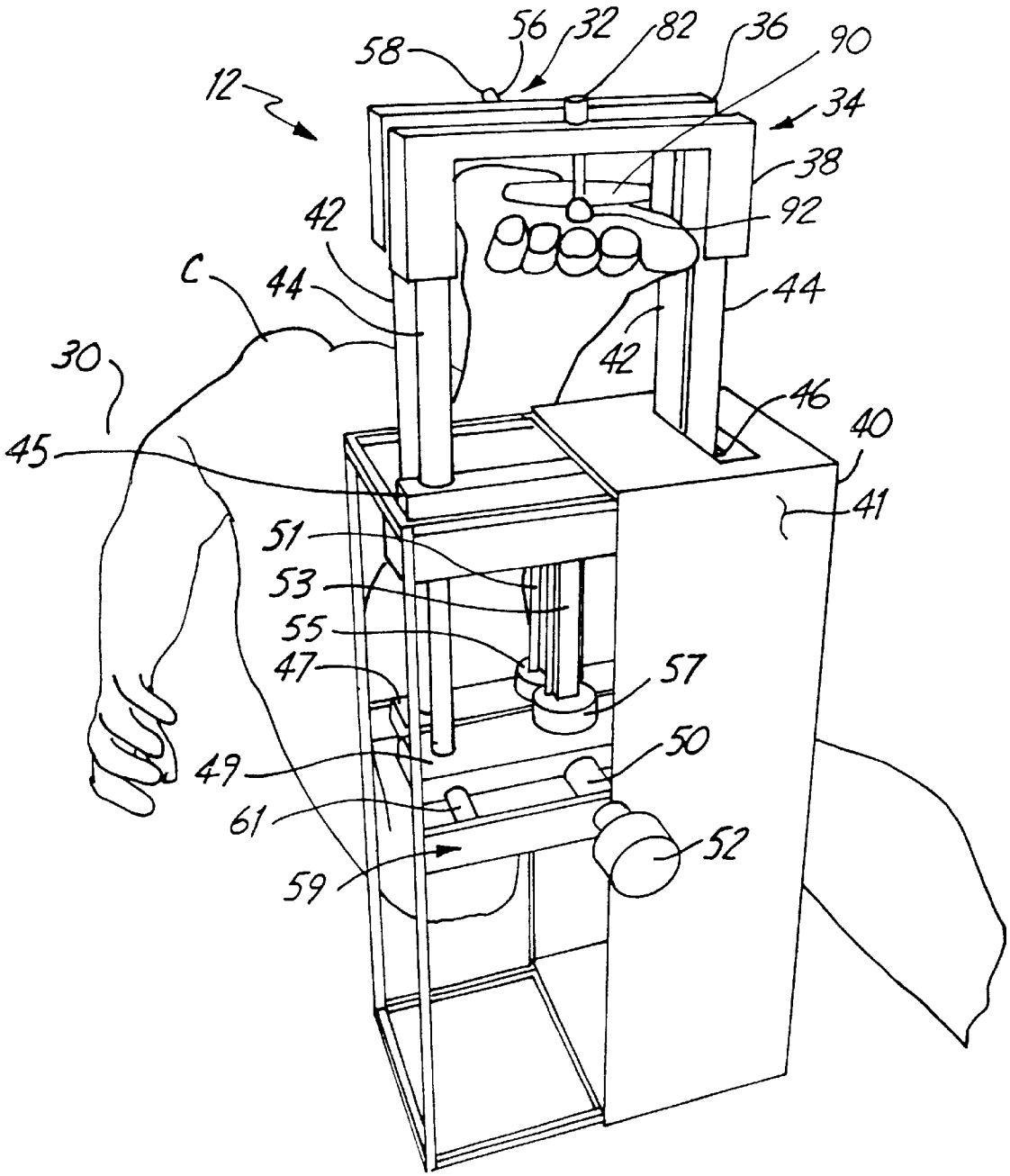
FIG. 2 is a perspective view of a rearfoot and forefoot goniometer according to the present invention with a portion of the support enclosure removed.

A conventional linear slide control apparatus 59 is housed within the support enclosure 40 and includes rearfoot and forefoot cross members 43 (shown in FIG. 4) and 45 and rearfoot and forefoot slider tables 47 and 49. The support enclosure 40 has a pair of bores formed in the upper surface thereof through which the upper portion of the rearfoot telescopic uprights 42 pass and connect to the rearfoot cross member 43. The lower portions of the rearfoot telescopic uprights 42 pass through vertical bores formed in the rearfoot cross member 43 to mate with (by sliding within) the upper portions of the rearfoot telescopic uprights 42. The support enclosure 40 also has a pair of horizontal positioning tunnels 46 (only one of which is shown in FIG. 2) through which the upper portions of the forefoot telescopic support uprights 44 pass and connect to the forefoot cross member 45. The lower portions of the forefoot telescopic uprights 44 pass through vertical bores formed in the forefoot cross member 45 to mate with (by sliding within) the upper portions of the forefoot telescopic uprights 44. The bottom ends of the lower portions of the pair of rearfoot telescopic uprights 42 are fixably mounted at opposite lateral ends of the rearfoot slider table 47, and the bottom ends of the lower portions of the pair of forefoot telescopic uprights 44 are fixably mounted at opposite lateral ends of the forefoot slider table 49.

Rearfoot and forefoot telescoping shafts 51 and 53 are connected at their upper ends to the rearfoot and forefoot upper support cross members 43 and 45, respectively, and at their bottom ends to the rearfoot and forefoot slider tables 47 and 49, respectively. The rearfoot and forefoot telescoping shafts 51 and 53 are threaded and conventional rearfoot and forefoot servomotors 55 and 57 are coaxially mounted about the rearfoot and forefoot telescoping shafts 51 and 53, respectively, and engage the threads on the rearfoot and forefoot telescoping shafts 51 and 53 so that the servomotors 55 and 57 can be used to vertically position the rearfoot and forefoot cross members 43 and 45, respectively, by screwing the rearfoot and forefoot telescoping shafts 51 and 53 in a conventional manner. The rearfoot and forefoot cross members 43 and 45 slide along the lower portions of the rearfoot and forefoot telescopic uprights 42 and 44 (respectively), which pass through bores formed in the rearfoot and forefoot cross members 43 and 45 (respectively) and are received within the upper portions of the rearfoot and forefoot telescopic uprights 42 and 44 (respectively), when the rearfoot and forefoot cross members 43 and 45 are vertically positioned by the servomotors 55 and 57 and the rearfoot and forefoot telescoping shafts 51 and 53. A control panel 48

(shown in FIG. 3) is mounted on an outer surface of the support enclosure 40 and comprises standard rocker switches electrically connected to the linear slide control apparatus 59 for providing directional input to the rearfoot and forefoot servomotors 55 and 57.

The linear slide control apparatus 59 also includes a pair of horizontal guide shafts 61 (only one of which is shown in FIG. 2) that pass through horizontal bores formed at opposite lateral ends of the rearfoot and forefoot slider tables 47 and 49. The rearfoot slider table 47 is fixedly attached to the guide shafts 61, whereas the forefoot slider table 49 is slidably mounted to the horizontal guide shafts 61. The forefoot slider table 49 (and the telescopic support uprights 44 and the forefoot goniometer apparatus 34 attached thereto) can be horizontally positioned by screwing a threaded forefoot alignment shaft 50 (by turning an alignment knob 52 attached to a distal end of the shaft 50) through an opening 63 formed in the support enclosure 40.

Rearfoot goniometer apparatus 32 includes a conventional telescopic alignment shaft 56 (perhaps shown best in FIG. 5) mounted at a proximal end to the rearfoot attachment interface 36 and extending horizontally therefrom. Telescopic alignment shaft 56 can be horizontally telescoped by rotating a horizontal alignment knob 58 in order to horizontally align a vertical support member 60 attached to the telescopic alignment shaft 56. Vertical support member 60 has a bore formed therethrough, through which a rotation shaft 62 (perhaps shown best in FIG. 5) passes so as to be rotatably mounted to the vertical member 60. A calcaneal clamp 64 is mounted to the rotation shaft 62 so that the calcaneal clamp 64 can rotate about a customer's foot F during the assessment. Calcaneal clamp 64 comprises a horizontal member 66 attached directly to the rotation shaft 62. Clamp members 68 and 70 are rotatably mounted to opposite ends of the horizontal member 66 by conventional spring-loaded compression joints 72. Calcaneal attachment pads 74 are mounted to the distal ends of the clamp members 68 and 70 and come into contact with the customer's heel bone during the assessment. A rearfoot goniometer sensor 76, which can be a conventional, accurate (preferably, less than 1 degree error) linear potentiometer attached directly to the rotation shaft 62 in order to produce a analog signal that is proportional to the rotation of the clamp 64 about the shaft 62. The signal produced by the sensor 76 is then provided to the standard A/D converter 18 (shown in FIG. 1), preferably a standard 12-bit A/D converter, in order to produce a digital signal representative of the rotation of the clamp 64 about shaft 62 that can be used by the computer 22. Alternatively, a conventional precision digital encoder can be used as the sensor 76. Such a precision digital encoder can be used to produce a digital signal proportional to the rotation of the clamp 64 about the shaft 62 without using an A/D converter 18.

Forefoot goniometer apparatus 34 (perhaps shown best in FIGS. 6 and 7) includes a metatarsal alignment shaft 78 that passes through a vertical bore formed in the forefoot attachment interface 38. A horizontal support shaft 80 is attached at a first end to the bottom end of the alignment shaft 78. A knob 82 for rotating the metatarsal alignment shaft 78 (and the support shaft 80 attached thereto) is attached to the top end of the shaft 78. A vertical support member 84 is attached to a second end of the horizontal support member 80. A bushing 86 (shown in FIG. 7) is attached to the bottom end of the vertical support member 84. A forefoot goniometer rotation shaft 88 passes through the interior of the bushing 86 and is attached at a distal end to a forefoot assessment pad 90. The assessment pad 90 rotates about rotation shaft 88 during the assessment process. A forefoot goniometer sensor 92, of the same type as rearfoot goniometer 76, is coupled to the rotation shaft 88 to produce an analog signal proportional to the rotation of the assessment pad 90 about the rotation shaft 88. The signal produced by the sensor 92 is then provided to the A/D converter 18 in order to produce a digital signal representative of the rotation of the assessment pad 90 about the rotation shaft 88 that can be used by the computer 22.

The raw materials of all shafts (both solid and hollow) are preferably made from stainless steel or molded polyurethane and are readily commercially available. These components are preferably then machined and/or molded to appropriate specifications. The forefoot assessment pad 90 and calcaneal clamp 64 are preferably made from molded polyurethane and machined to appropriate specifications. Attachment interfaces such as springs, bushings, couplers, and bearings are all readily commercially available. The support enclosure 40 is made from a stainless steel frame and machined to appropriate specifications. An outer cover 41 (which is partially shown in FIG. 2) of the support enclosure 40 comprises five molded polyurethane panels and can further include a vinyl-covered foam pad attached to the rearfoot surface of the support enclosure 40 in order to cushion the customer's shin during the assessment process. Servomotors and linear slider tables for the telescopic support shafts and electrical components such as linear potentiometers, switches, A/D converters, and 115 V power supply conditioning components are readily commercially available standard materials and devices.

One embodiment of a shoe press 26 of the present invention is shown in FIGS. 8–14. Shoe press 26 includes a pair of telescopic support uprights 102 that are supported by a platform base housing 104 (the outer cover of which is not in FIGS. 8–14) and are attached to a servo control housing 106 (the outer cover of which is not shown in FIGS. 8–14). A height adjustment knob 108 is mounted on the side of the platform housing 104 and is attached to a first end of a vertical positioning shaft 105. The vertical positioning shaft 105 is operatively connected to a conventional slider mechanism in a conventional manner (e.g., by a 90 degree transmission gear) so that the telescopic uprights 102 and the servo control housing 106 can be vertically adjusted by rotating the height adjustment knob 108. The servo control housing 106 houses rearfoot and forefoot slider tables 107 and 109, on which rearfoot and forefoot servo motors 111 and 113, respectively, are mounted.

Figure 9:
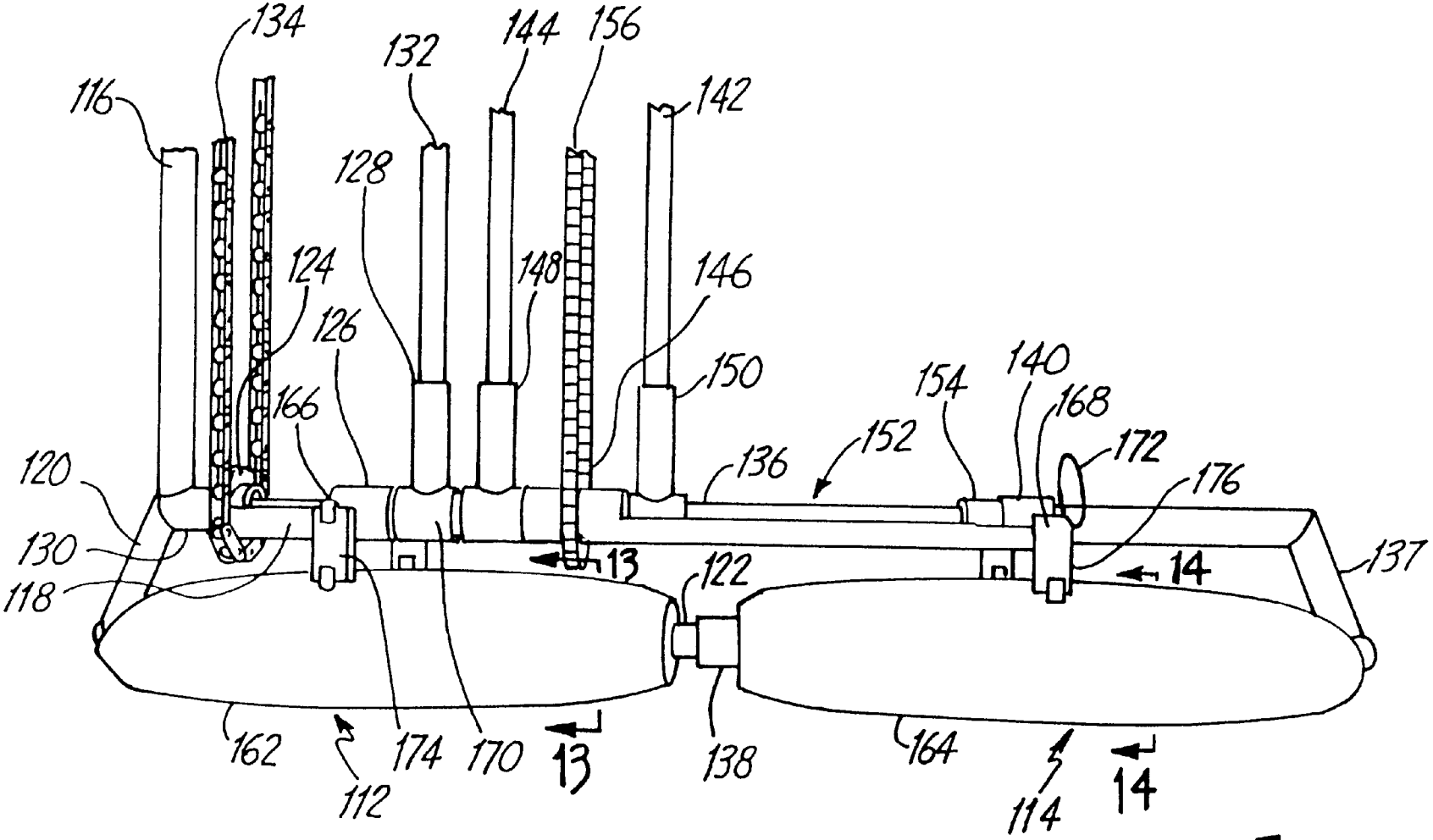
FIG. 9 is a side view of the rearfoot and forefoot press mechanisms of the shoe press shown in FIG. 8.
Figure 10:
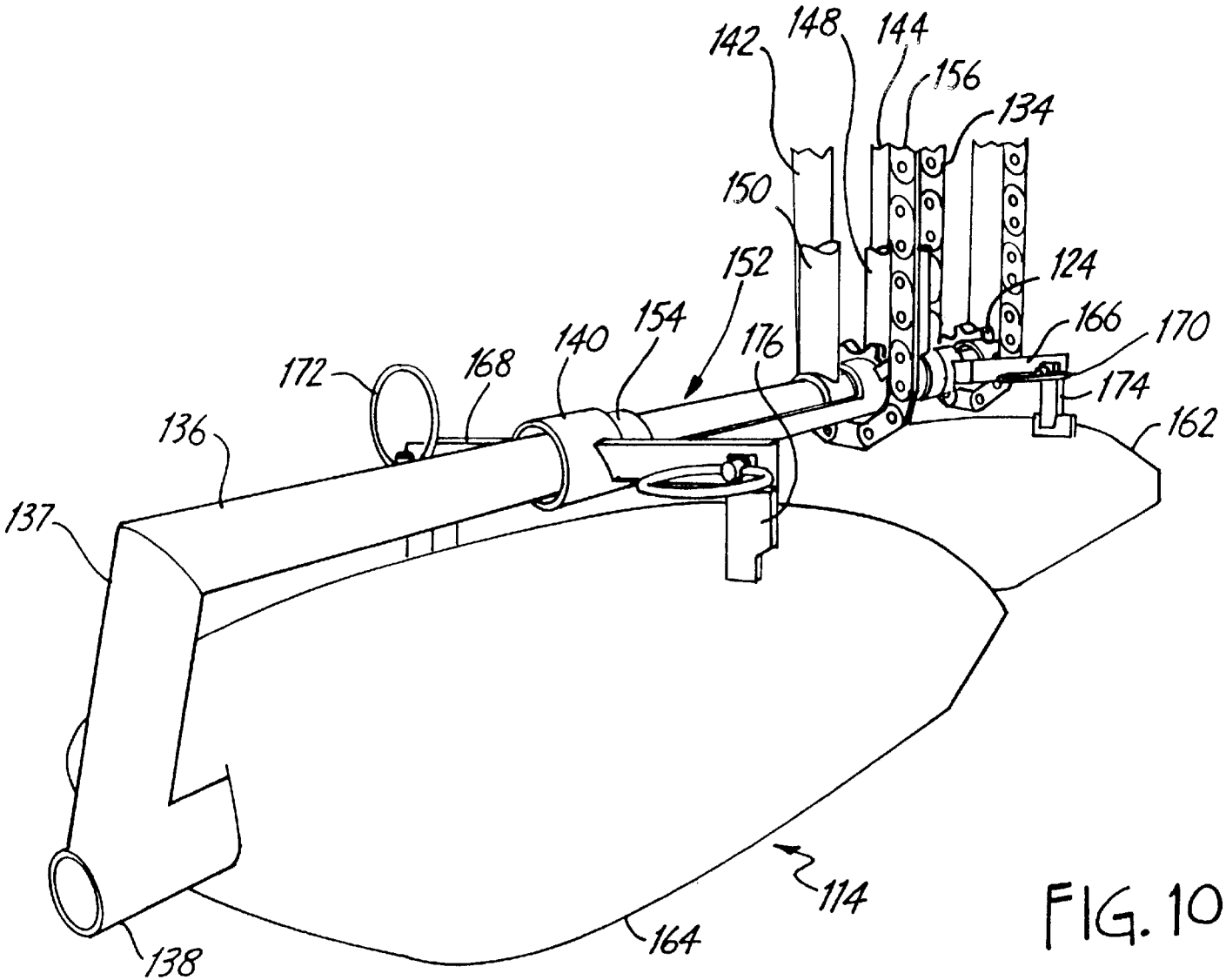
FIG. 10 is a partial front perspective view of the rearfoot and forefoot press mechanism shown in FIG. 8.
Figure 11:
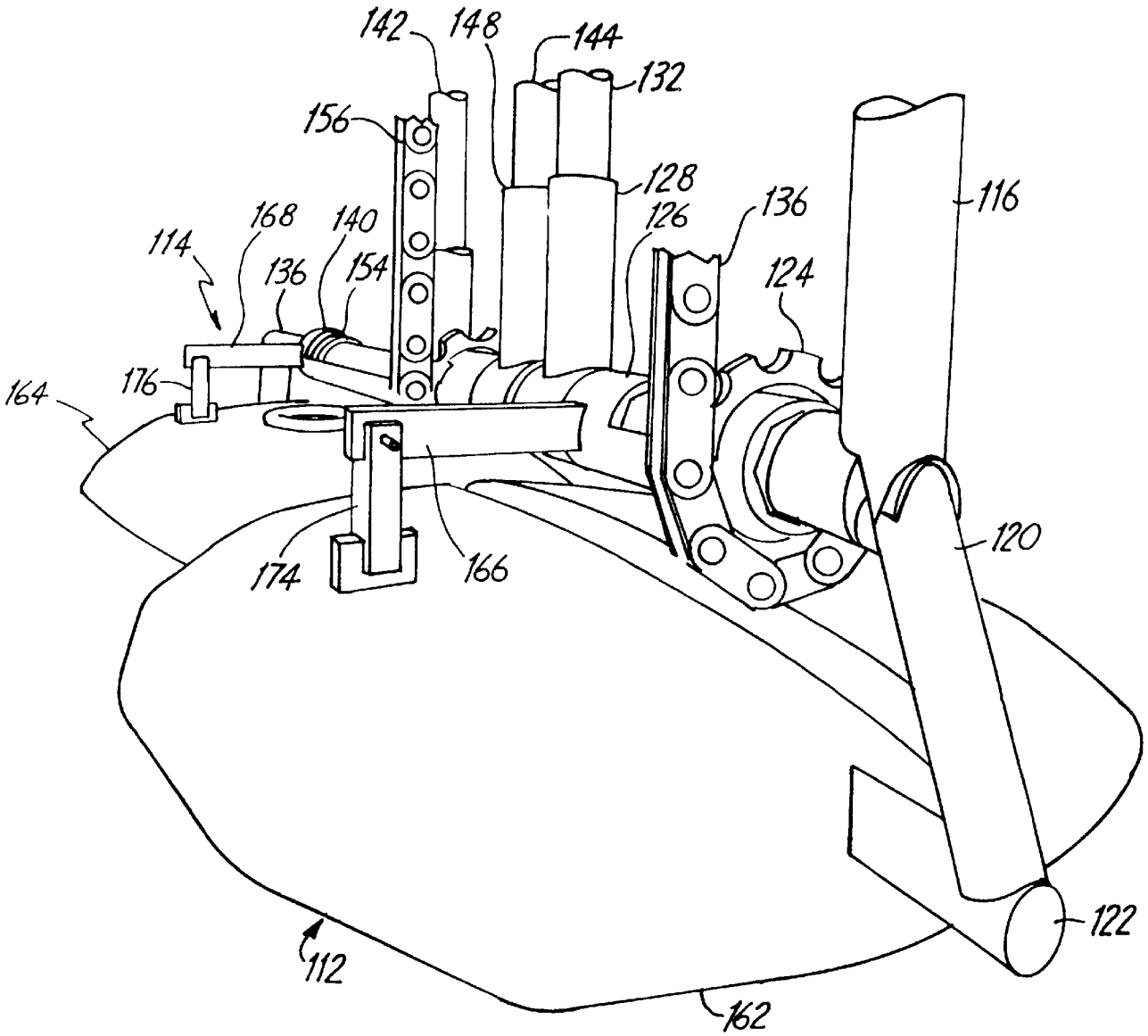
FIG. 11 is a partial rear perspective view of the rearfoot and forefoot press mechanism shown in FIG. 8.

As shown in FIG. 9, four vertical support shafts extend from the servo control housing 106 to support rearfoot and forefoot press mechanisms 112 and 114. The rearfoot press mechanism 112 includes a rear vertical support shaft 116 having an upper end attached to the rearfoot slider table 107 and a lower end rigidly attached to a rear upper horizontal support shaft 118 and a rear lower vertical support shaft 120. A rear lower horizontal support shaft 122 is rigidly attached to the rear lower vertical support shaft 120 at a substantially right angle. Preferably, these four shafts 116, 118, 120, and 122 are all part of one solid piece of cast stainless steel construction having a shaft diameter of approximately ⅜ inches.

A rearfoot press drive sprocket 124 is rigidly attached to a rearfoot press rocker shaft 126, which is of tubular construction and preferably has an inside diameter of approximately 7/16 inches. The rearfoot press rocker shaft 126 is coaxially mounted around the rear upper horizontal support shaft 118 and is able to rotate around the shaft 118. The rearfoot press rocker shaft 126 is held in place horizontally by front and rear rearfoot press spacers 128 and 130, both of which have a horizontal bore formed therein through which the rear upper horizontal support shaft 118 passes. The front rearfoot press spacer 128 is rigidly attached to the lower end of a rearfoot vertical support shaft 132. The upper end of the rearfoot vertical support shaft 132 is fixedly mounted to the rearfoot slider table 107 (shown in FIG. 12) and holds the rearfoot press rocker shaft 126 in a fixed horizontal position along the rear upper horizontal support shaft 118. The rear rearfoot press spacer 130 is fixedly mounted to the rear end of the rear upper horizontal support shaft 118. The inside diameter of the horizontal bores of the spacers 128 and 130 preferably are approximately 7/16 inches. A rearfoot drive chain 134 is looped around the rearfoot drive sprocket 124 and a rearfoot servo sprocket 125 (shown in FIG. 12), which is attached to the rearfoot servo motor 111 mounted on the rearfoot slider table 107. Thus, when the rearfoot servomotor 111 rotates the rearfoot sprocket 125, the drive chain 134 will cause the rearfoot drive sprocket 124 to rotate the rearfoot press rocker shaft 126 about the rear upper horizontal support shaft 118. The motion of the servomotor 111 is controlled by a footwear customization program (described below) running on computer 22. This motion will provide the correct offsets and pressure to the customizable shoe according to the rearfoot and forefoot alignment data provided by the RAF goniometer 12 during the customer's assessment.

As shown in FIG. 9, the forefoot press mechanism 114 comprises upper and lower horizontal support shafts 136 and 138, which are mounted telescopically over shafts 118 and 122, respectively, so that the forefoot press mechanism 114 can slide horizontally along shafts 118 and 122. Preferably the rear upper and lower horizontal support shafts 118 and 122 have a length of 7½", which should accommodate a size range of shoes from a women's size 5 to a men's size 14. A front lower vertical support shaft 137 has one end connected to the distal end of the upper horizontal support shaft 136 and a second end connected to the distal end of the lower horizontal support shaft 138. A forefoot rocker shaft 140 having a tubular construction is coaxially mounted around the upper horizontal support shaft 136. The forefoot rocker shaft 140 has an opening 152 formed therein that provides access to the upper horizontal support shaft 136. The forefoot press mechanism 114 also includes front and rear forefoot vertical support shafts 142 and 144 that have their upper ends attached to the forefoot slider table 109 (shown in FIG. 12) and their lower ends attached to the upper horizontal support shaft 136 on either side of a forefoot press drive sprocket 146 that is coaxially mounted to the forefoot rocker shaft 140. The lower end of the rear forefoot vertical support shaft 144 is rigidly attached to a rear forefoot press spacer 148. The rear forefoot press spacer 148 has a horizontal bore therethrough and is fixably mounted to the upper horizontal support shaft 136 to help hold the forefoot rocker shaft 140 in its horizontal position. The lower end of the front forefoot vertical support shaft 142 is rigidly attached to a front forefoot press spacer 150, which also has a horizontal bore therethrough. The front forefoot press spacer 150 passes through the opening 152 formed in the forefoot rocker shaft 140 and is fixedly mounted to the upper horizontal support shaft 136. The front forefoot press spacer 150 is mounted adjacent a first end of the opening 152 near the forefoot drive sprocket 146 on the side opposite the rear forefoot press spacer 148. A forefoot rocker shaft support spacer 154 is mounted to the upper horizontal support shaft 136 within the opening 152 adjacent a second end thereof to further stabilize the forefoot rocker shaft 140.

Similar to the rearfoot press mechanism 112, the forefoot press mechanism 114 includes a forefoot drive chain 156 that has one end looped around the forefoot drive sprocket 146 and the other end looped around a forefoot servo sprocket 129 (shown in FIG. 12) attached to the forefoot servo motor 113 to allow rotation of the rocker shaft 140 when the forefoot servo motor 113 drives the forefoot drive chain 156.

Figure 12:
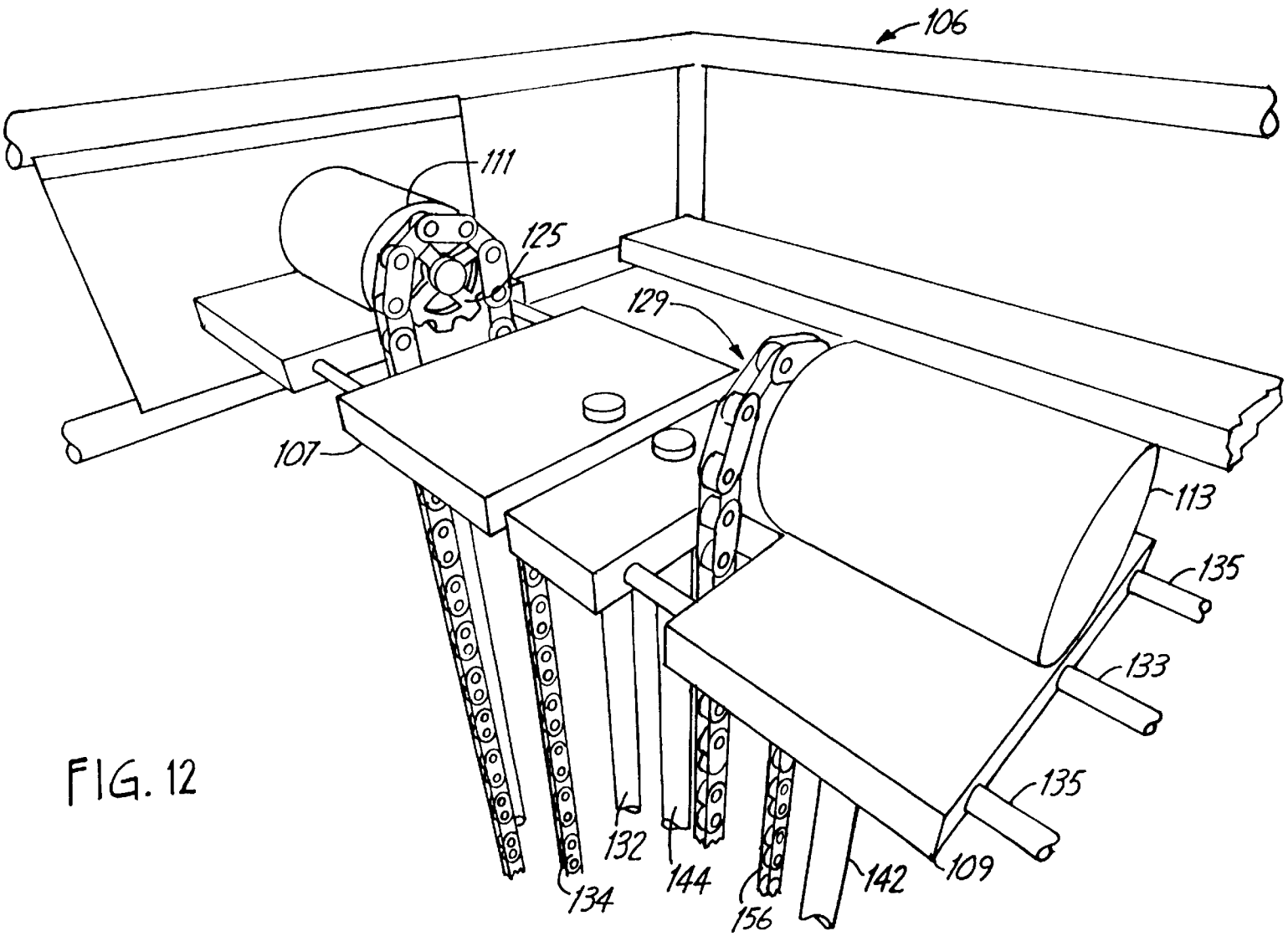
FIG. 12 is a partial perspective view of a portion of the servo control housing of the shoe press shown in FIG. 8.
Figure 13:
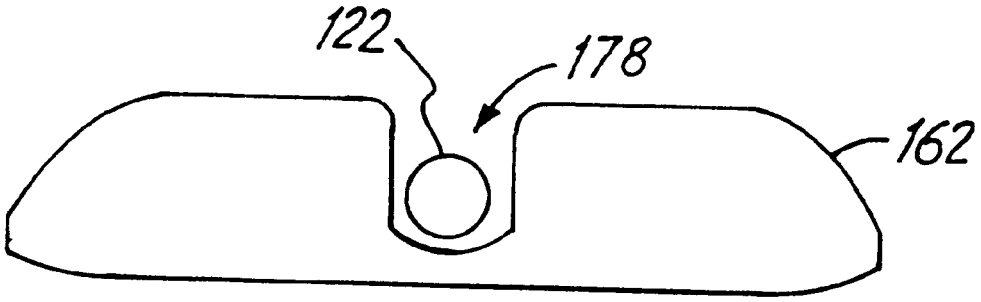
FIG. 13 is a cross-sectional view of the rearfoot press pad shown in FIG. 9 taken along the line 13—13.
Figure 14:
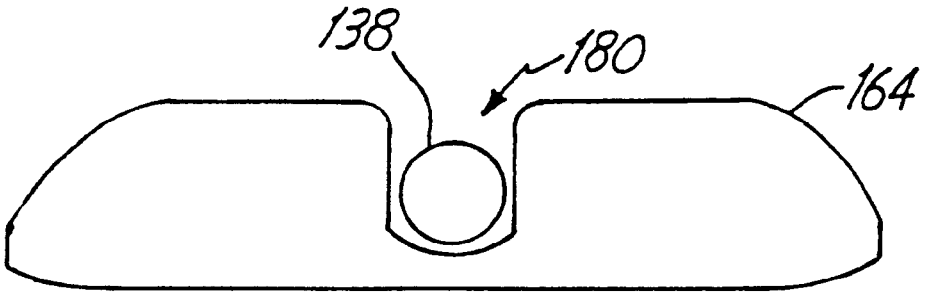
FIG. 14 is a cross-sectional view of the forefoot press pad shown in FIG. 9 taken along the line 14—14.

Referring now to FIG. 12, the forefoot press mechanism 114 is horizontally positioned, in order to accommodate shoes of differing sizes, by rotating a horizontal positioning knob (not shown) that is attached to a threaded positioning shaft 133. The positioning shaft 133 passes through a bore formed in the rearfoot slider table 107, which is fixedly attached to the servo control housing 106 and does not slide when the positioning shaft 133 is rotated. The positioning shaft 133 also passes through a bore formed in the forefoot slider table 109 that has threads formed on the interior surface thereof that mate with the threads on the positioning shaft 133 so that the forefoot slider table 109 can be horizontally positioned by rotating the positioning shaft 133. A pair of guide shafts 135 pass through additional bores formed in the rearfoot and forefoot slider tables 107 and 109 to help stabilize, support, and guide the rearfoot and forefoot slider tables 107 and 109. When the positioning knob attached to the positioning shaft 133 is rotated, the forefoot slider table 109 is screwed along the threaded positioning shaft 133, which causes the forefoot press mechanism 114 (including the forefoot vertical support shafts 142 and 144 and the drive chain 156) to move horizontally. This horizontal movement is facilitated by the telescopic nature of the forefoot press mechanism 114 as the upper and lower horizontal support shafts 136 and 138 slide over the support shafts 118 and 122. It is to be understood, however, that other approaches to positioning the forefoot press mechanism 114 can be used. For example, the forefoot servo motor 113 can be coupled to the positioning shaft 133 to rotate the positioning shaft 133 in order to move the forefoot slider table 109 along the positioning shaft 133.

As shown in FIG. 9, rearfoot and forefoot press pads 162 and 164 are attached to the rearfoot and forefoot rocker shafts 126 and 140, respectively. Extending from rocker shafts 126 and 140 are rearfoot and forefoot press control arms 166 and 168, respectively. The control arms 166 and 168 contain small holes through which pad connecting pins 170 and 172, respectively, are placed to rigidly attach rearfoot and forefoot press pad attachment clevices 174 and 176 to the control arms 166 and 168. The devices 174 and 176 contain holes matching those of the control arms 166 and 168, and the devices 174 and 176 are wide enough to fit over each control arm 166 and 168. Press pads 162 and 164 also contain grooves 178 (perhaps shown best in FIG. 13) and 180 (perhaps shown best in FIG. 14), respectively, which are slightly wider than each of the lower horizontal support shafts 122 and 138 so that the lower horizontal support shafts 122 and 138 can pass therethrough. The devices 174 and 176 and the grooves 178 and 180 allow the press pads 162 and 164 to be changed according to the customer's shoe size. Shoe size also will determine what horizontal position the forefoot press mechanism 114 occupies.

Figure 15:
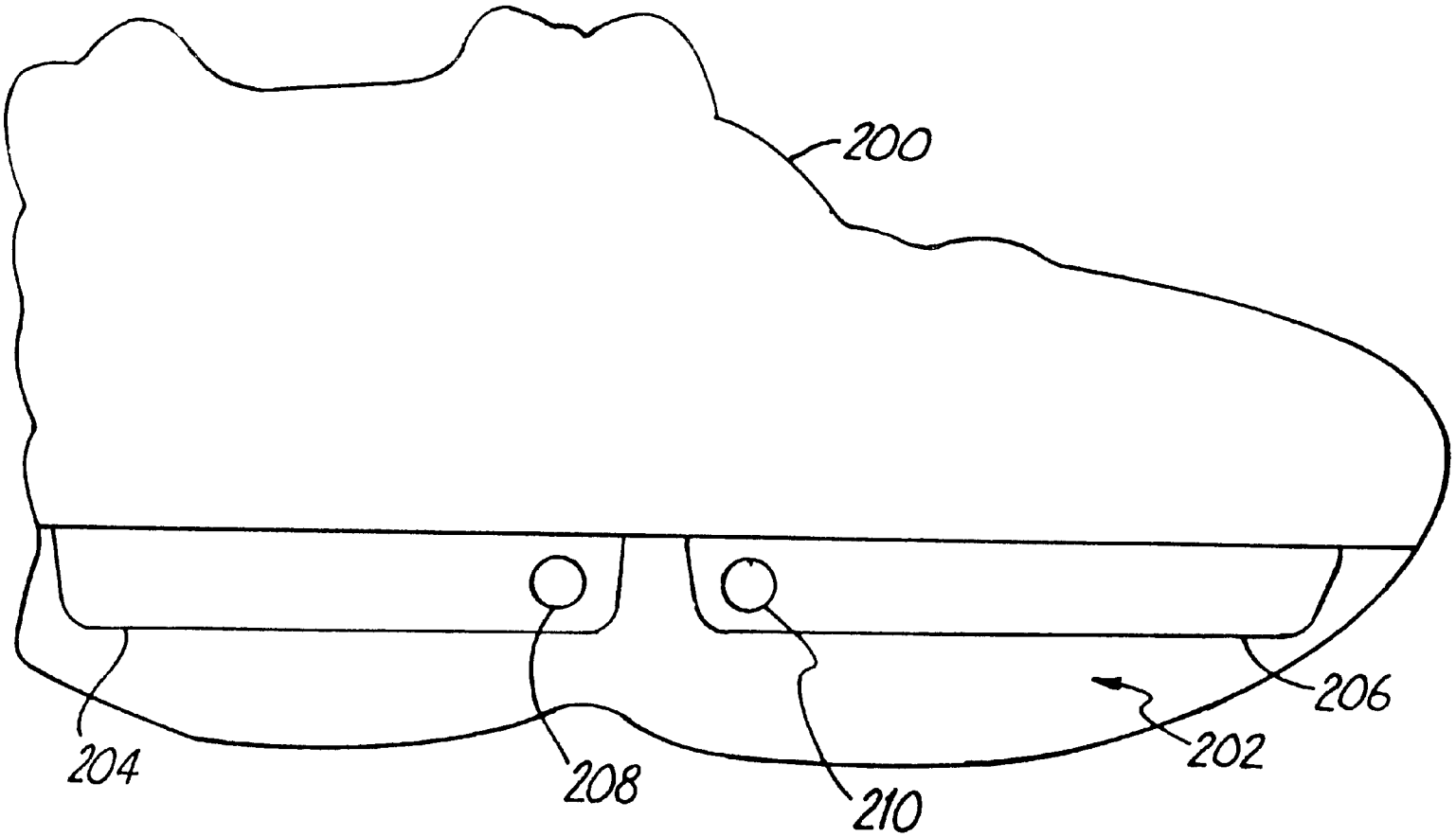
FIG. 15 is a schematic diagram of one embodiment of a customizable shoe according to the present invention.

One embodiment of a customizable piece of footwear according to the present invention comprises a customizable shoe 200 shown in FIG. 15. Shoe 200 has a moldable, settable midsole 202 that includes rearfoot and forefoot bladders 204 and 206. The rearfoot and forefoot bladders 204 and 206 include rearfoot and forefoot injection ports 208 and 210, respectively, via which fluids can be injected into the bladders 204 and 206. Preferably, the bladders 204 and 206 are made of molded polyurethane and are contained within the midsole 202 of the shoe 200. Also, the rearfoot bladder 204 is preferably designed to provide up to about 9 millimeters of rearfoot varus or valgus correction of the calcaneus, and the forefoot bladder 206 is preferably designed to provide up to about 9 millimeters of varus or valgus correction at the forefoot. It is to be understood, however, that the rearfoot bladder 204, the forefoot bladder 206, and the midsole 202 can be designed to provide more or less varus or valgus correction.

Figure 17:
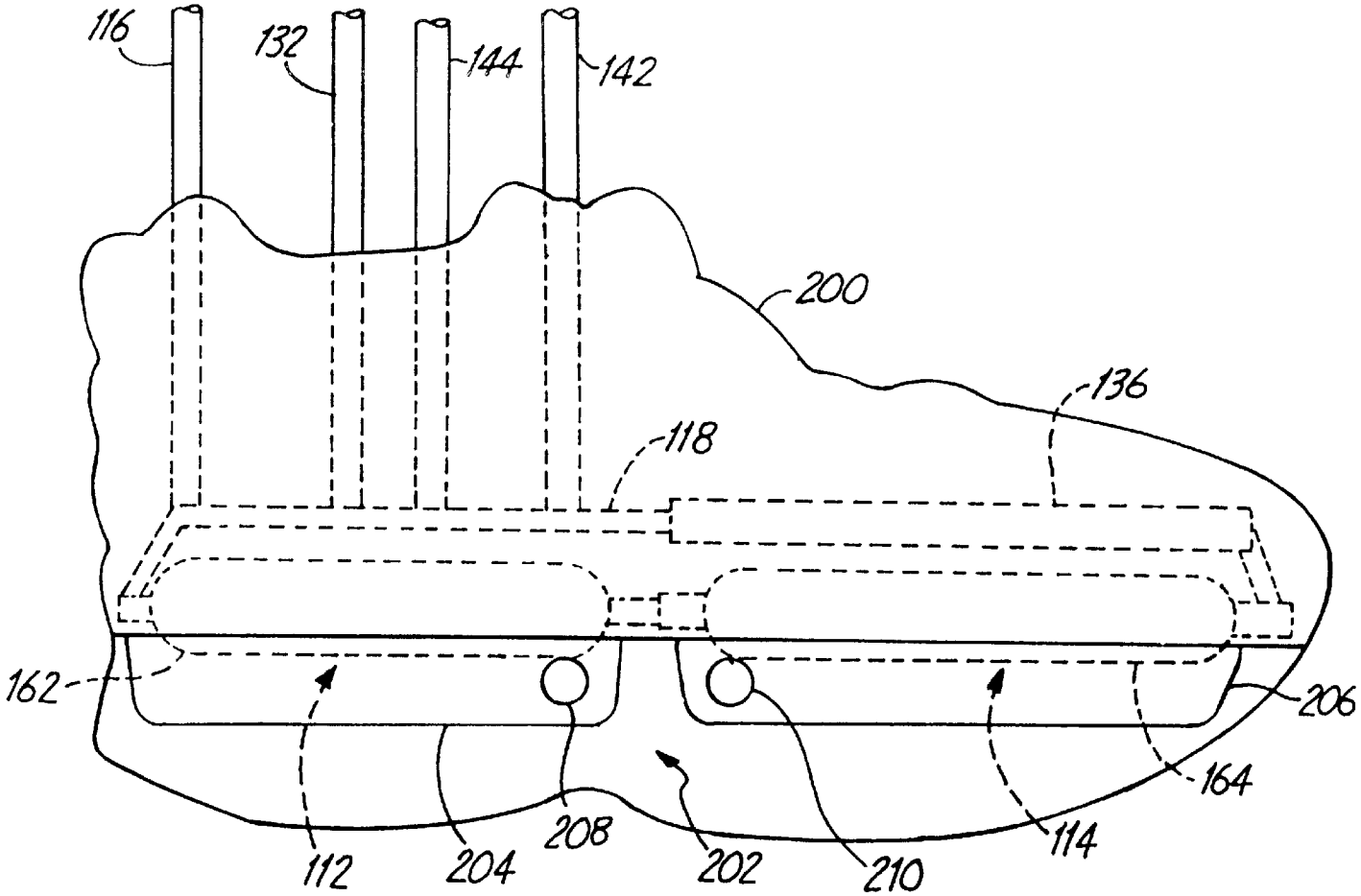
FIG. 17 is a schematic diagram of a customizable shoe mounted to rearfoot and forefoot press mechanisms of the present invention.

The rearfoot and forefoot bladders 204 and 206 can be provided with an aqueous solution contained within the bladder 204 and 206. In such an embodiment, the aqueous solution can be a polymer from the isocynate family of chemicals. Once the degree of correction has been determined by the RAF goniometer 12, the shoe 200 has been mounted on the shoe press 26 (as shown in FIG. 17), and the proper amount of alignment correction has been impressed into the rearfoot and forefoot bladders 204 and 206 of the shoe 200 by the shoe press 26, an active agent (or catalyst) such as an amine or polyol can be injected through the injection ports 208 and 210 into the bladders 204 and 206, respectively, to set the aqueous solution. The active agent reacts instantaneously with the polymer to form a semi-rigid polyurethane foam that maintains the correct alignment as assessed by the RAF goniometer 12 and imposed by the shoe press 26.

Any suitable injection apparatus 28 can be used to inject the active agent into the bladders 204 and 206. For example, the active agent can be injected into the bladders 204 and 206 through specially designed plastic tubing (not shown) that has a connection interface that mates with the injection ports 208 and 210 on the shoe 200. A precise amount of the active agent is forced into each bladder 204 and 206 by a conventional rapid injection molding system. It is to be understood, however, that any suitable rapid injection molding or reaction injection molding system could be modified for use in the present invention as the injection apparatus 28.

Figure 16:
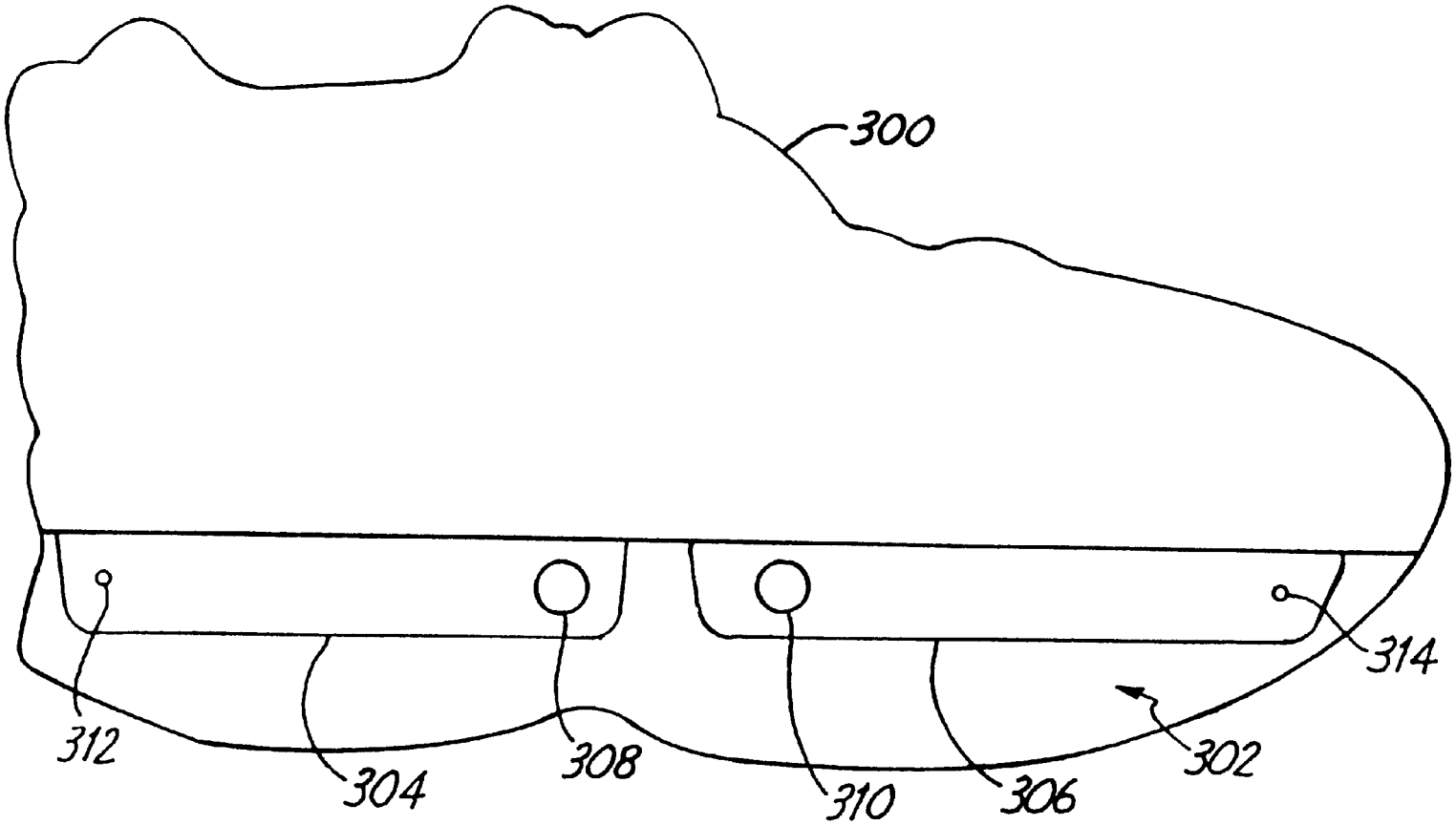
FIG. 16 is a schematic diagram of a second embodiment of a customizable shoe according to the present invention.

Another embodiment of a customizable shoe 300 that can be used with the present invention is shown in FIG. 16. Shoe 300 is similar to the shoe 200 (wherein similar components are numbered with like numbers incremented by 100) and can be used with a standard conventional polyurethane injection molding system to set the rearfoot and forefoot bladders 304 and 306. Shoe 300 is provided with bladders 304 and 306 that, instead of containing an aqueous solution as with shoe 200, contain ambient air (or other suitable gas) at a suitable pressure, e.g., atmospheric pressure. The rearfoot and forefoot bladders 304 and 306 include exhaust valves 312 and 314 so that the air (or other gas) that is originally provided in the bladders 304 and 306 can exit therefrom during injection. Once the degree of correction has been determined by the RAF goniometer 12, the shoe 300 has been mounted on the shoe press 26, and the proper amount of alignment correction has been impressed into the rearfoot and forefoot bladders 304 and 306 of the shoe 300 by the shoe press 26, polyurethane foam can be injected through the injection ports 308 and 310 into the bladders 304 and 306. As the polyurethane foam fills the bladders 304 and 306, the air (or other gas) exits the bladders 304 and 306 through the exhaust valves 312 and 314.

There are several commercially available systems for injecting polyurethane foam that are suitable to use as the injection apparatus 28 with customizable shoe 300. In most methods, an isocynate solution is mixed with a polyol by impingement. The resulting polyurethane foam is then expelled in precise amounts to the desired location. The simplest and most inexpensive method uses a specially designed syringe (not shown). The syringe contains two compartments—one to house the isocynate solution and the other for the polyol solution. The syringe contains two plungers—one for each ingredient solution compartment. As the plungers of the syringe are depressed, each solution is forced into a mixing chamber and then out the syringe expulsion valve. This expulsion valve is connected to the input ports 308 and 310 of the rearfoot and forefoot bladders 304 and 306 where the newly formed polyurethane foam is to reside. As the polyurethane foam fills the entire volume of the bladders 304 and 306 to their specified shape, the air previously contained within the bladders is forced through the exhaust valves 312 and 314. The syringe plunger is calibrated to force precise amounts of the ingredient solutions from each compartment into the mixing chamber. Based on the calibration, the desired material characteristics and dispersion volume of the foam can be set to meet the requirements' of the bladders/shoe complex. This process typically takes the longest (typically around 1 minute per bladder) of all the injection processes described herein and has the most variability in the resulting foam properties.

Another polyurethane injection system that can be used as an injection apparatus 28 for use with customizable shoe 300 uses a mechanical mixing system (not shown). These systems contain storage compartments for the ingredient solutions that can house large quantities of these solutions (some are even temperature controlled). A metered pump system is used to move precise amounts of the ingredient solutions into a mixing chamber where they are mixed by impingement using high pressure or under low pressure while using a mixing motor/blade system. The resulting polyurethane foam is then dispersed through a foam expulsion head interfaced to the injection ports 308 and 310 of the rearfoot and forefoot bladders 304 and 306 in the same manner as with the syringe system. The newly formed polyurethane foam fills substantially the entire volume of the bladders 304 and 306 in the shape imposed by the shoe press 26. Air previously contained within the bladders is forced out through the exhaust valves 312 and 314. This system is highly repeatable and relatively fast (typically each bladder can be filled in less than 10 seconds).

There are several other commercially available mechanical mixing systems available for injection molding of polyurethane containing different features that are desirable for the shoe customization process and system of the present invention. Different systems are superior for optimizing certain aspects of the injection process (e.g., precision in the density, hardness, volume of the foam, ease of cleaning, number of injection "shots"/day, local or EPA regulations, etc.). Elaborate automation systems exist that could be used to hasten the manufacturing process if extremely large numbers of shoes need to be processed. The exact system is chosen based on the requirements of the manufacturer and/or the model of shoe. Although the use of polyurethane foam has been described, it is to be understood that any moldable, settable fluid may be used in the bladders or midsole of a customizable shoe. For example, EVA or admixtures comprising EVA and/or polyurethane may be used.

Figure 18:
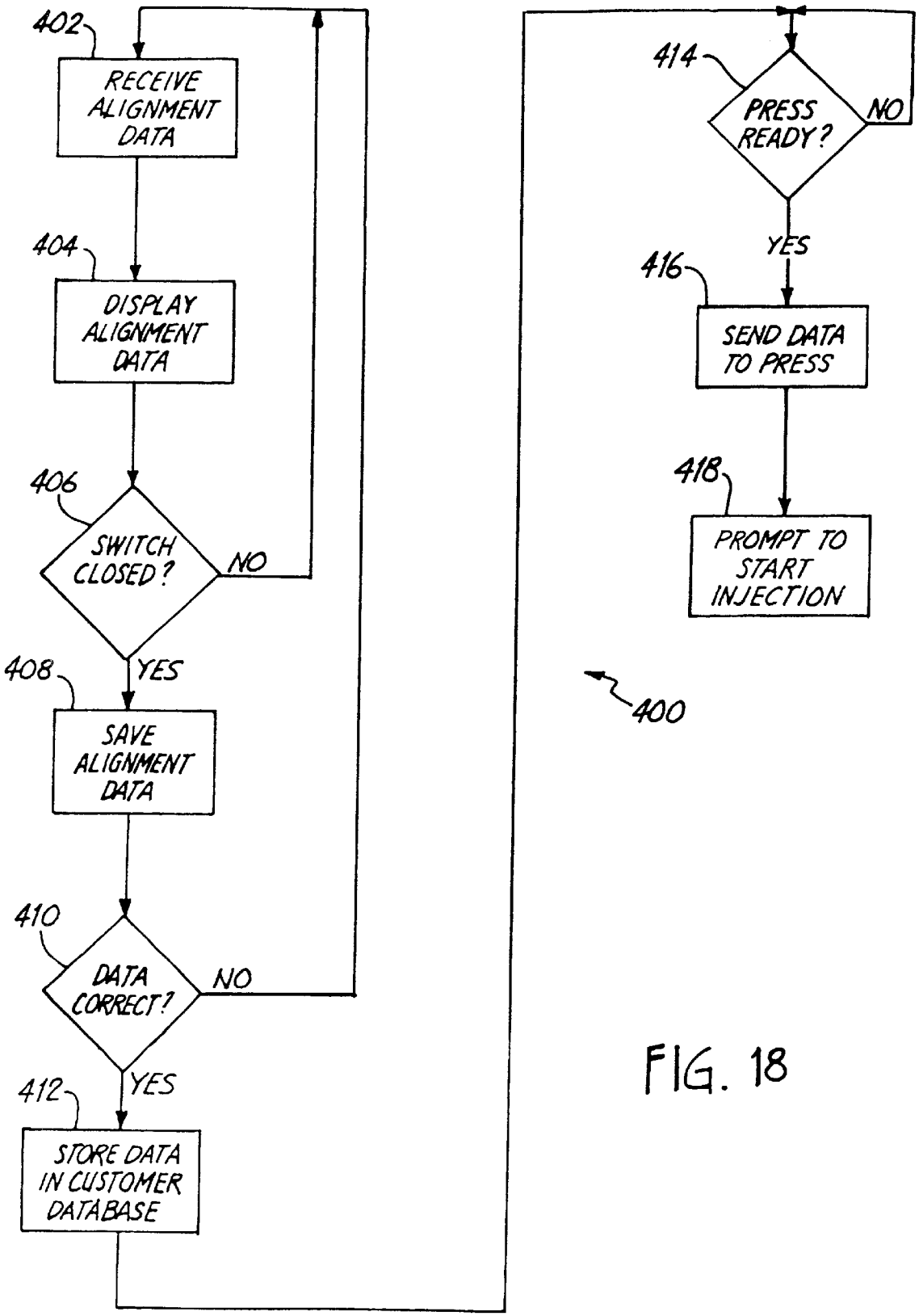
FIG. 18 is a flow diagram of a footwear customization program according to the present invention.

A flow diagram of a footwear customization program 400 for programming the computer 22 is shown in FIG. 18. Please note that although the flow diagram depicts a sequential series of processing steps, those of ordinary skill in the art will realize that a computer program created for use with a graphical user interface allows a user of the program to vary the actual order of processing. In order to focus more particularly on the present invention, the processing logic necessary for the present invention to operate under such a graphical environment has been omitted from FIG. 18.

In step 402, the rearfoot and forefoot alignment data is received from the A/D converter 18. In step 404, the rearfoot and forefoot alignment data is displayed on the monitor of the computer 22 for the technician to view. The program checks to see if the switch 24 connected to the computer 22 has been closed in step 406. If switch 24 has not been closed, then the program 400 loops back to step 402. If the switch 24 has been closed by the technician, the computer 22 stores the current rearfoot and forefoot alignment data in the computer 22 in step 408 and proceeds to step 410 where the computer prompts the technician to indicate whether the saved rearfoot and forefoot alignment data is correct. If the technician indicates that the saved data is not correct, then the program 400 loops back to step 402. If the technician indicates that the saved data is correct, then the program 400 proceeds to step 412 where the saved rearfoot and forefoot alignment data is stored in a customer database within the computer 22.

After the rearfoot and alignment data has been stored in the computer 22, the program 400 proceeds to step 414 where the technician is prompted to indicate when a customizable shoe has been mounted on the shoe press 26 and is ready for customization by the shoe press 26. After the technician mounts the customizable shoe and indicates that the shoe is ready for customization, the program 400 sends the rearfoot and forefoot alignment data to the shoe press 26 in step 416, which causes the shoe press 26 to impose the alignment correction into the midsole of the shoe. After the shoe press 26 has impressed the alignment correction into the midsole of the shoe, the program 400 prompts the technician to initiate injection of the active ingredient (or foam, as the case may be) in step 418. Alternatively, the computer 22 can be connected to the injection apparatus 28 and step 418 can be modified to initiate injection automatically.

The program 400 also can include the ability to retrieve a customer's previously stored rearfoot and forefoot alignment data from the customer database within the computer 22 for use with the shoe press 26. Also, the program 400 can include data analysis and reporting functions that operate on the alignment data stored in the customer database. Preferably, program 400 is written in the commercially available MICROSOFT VISUAL BASIC programming language and operates under the MICROSOFT WINDOWS operating system, though program 400 can be programmed in any suitable computer programming language and operate under any suitable operating system.

Figure 3:
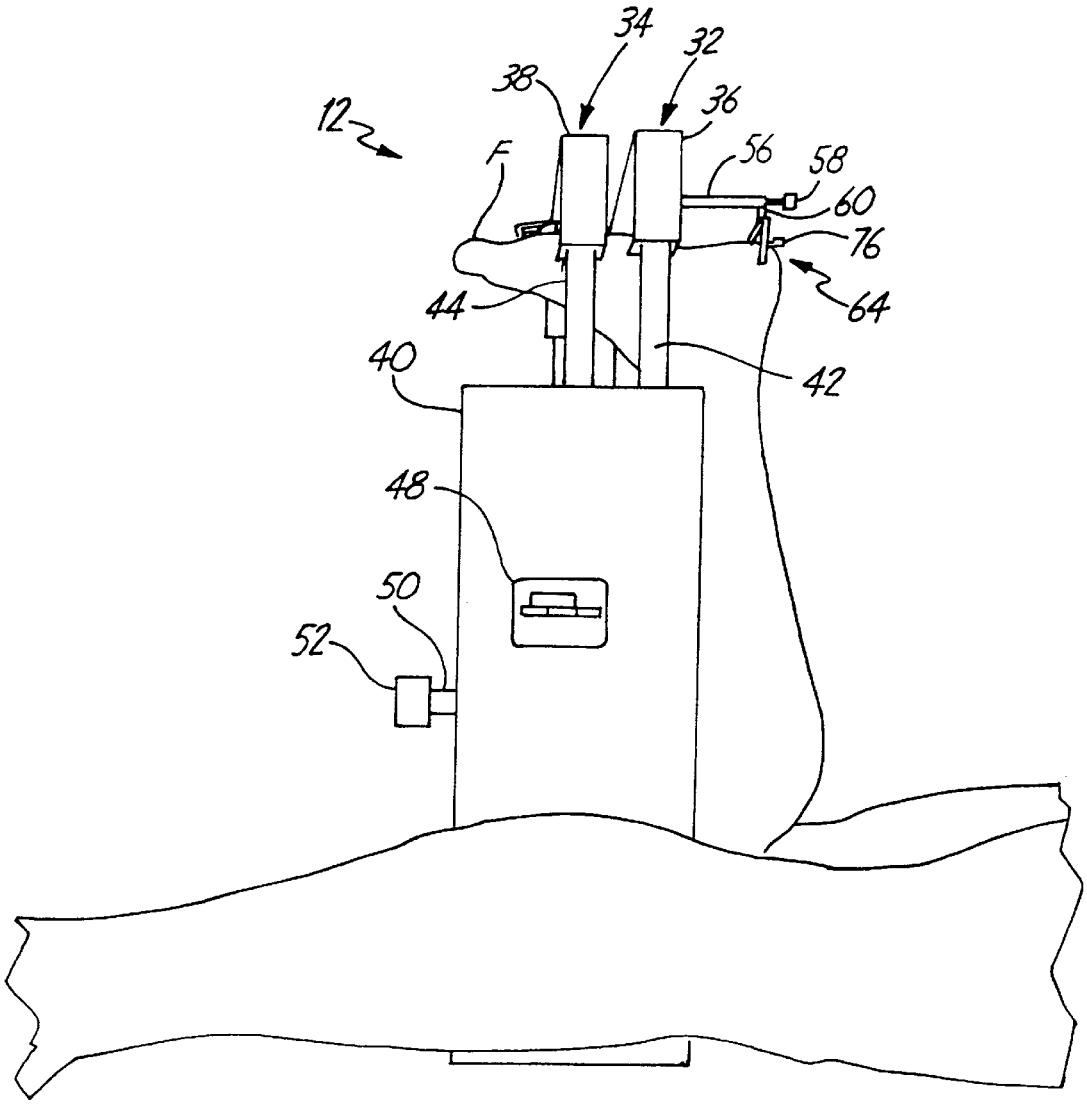
FIG. 3 is a side view of the rearfoot and forefoot goniometer shown in FIG. 2.

To use the system 10 of the present invention, the rearfoot and forefoot alignment of a customer's foot is measured to provide rearfoot and forefoot alignment data. The alignment assessment is made with the customer C (shown in FIG. 2) lying prone on the padded table 30. The customer's shin is placed firmly against the vinyl-covered foam pad on the rearfoot surface of the support enclosure 40 with the knee bent as shown in FIG. 3. The foot F is placed through and under the rearfoot and forefoot attachment interfaces 36 and 38 as shown in FIG. 3. The height of the attachment interfaces 36 and 38 is adjusted by manipulating the controls on the control panel 48 to move the telescopic support uprights 42 and 44 via the servomotors 55 and 57 within the support enclosure 40. Proper horizontal placement (in the direction of the heel and toe) of the rearfoot goniometer apparatus 32 is made using the telescopic rearfoot alignment shaft 56 by rotating the rearfoot goniometer horizontal alignment knob 58. Horizontal placement of the forefoot goniometer apparatus 34 is accomplished through rotation of the forefoot goniometer alignment knob and shaft 52 and 50, which causes the forefoot slider table 49 within the support enclosure 40 to move horizontally. In doing so, the entire forefoot goniometer apparatus 34 slides forward or backward within the support enclosure 40 and the horizontal positioning tunnel 46.

Figure 4:
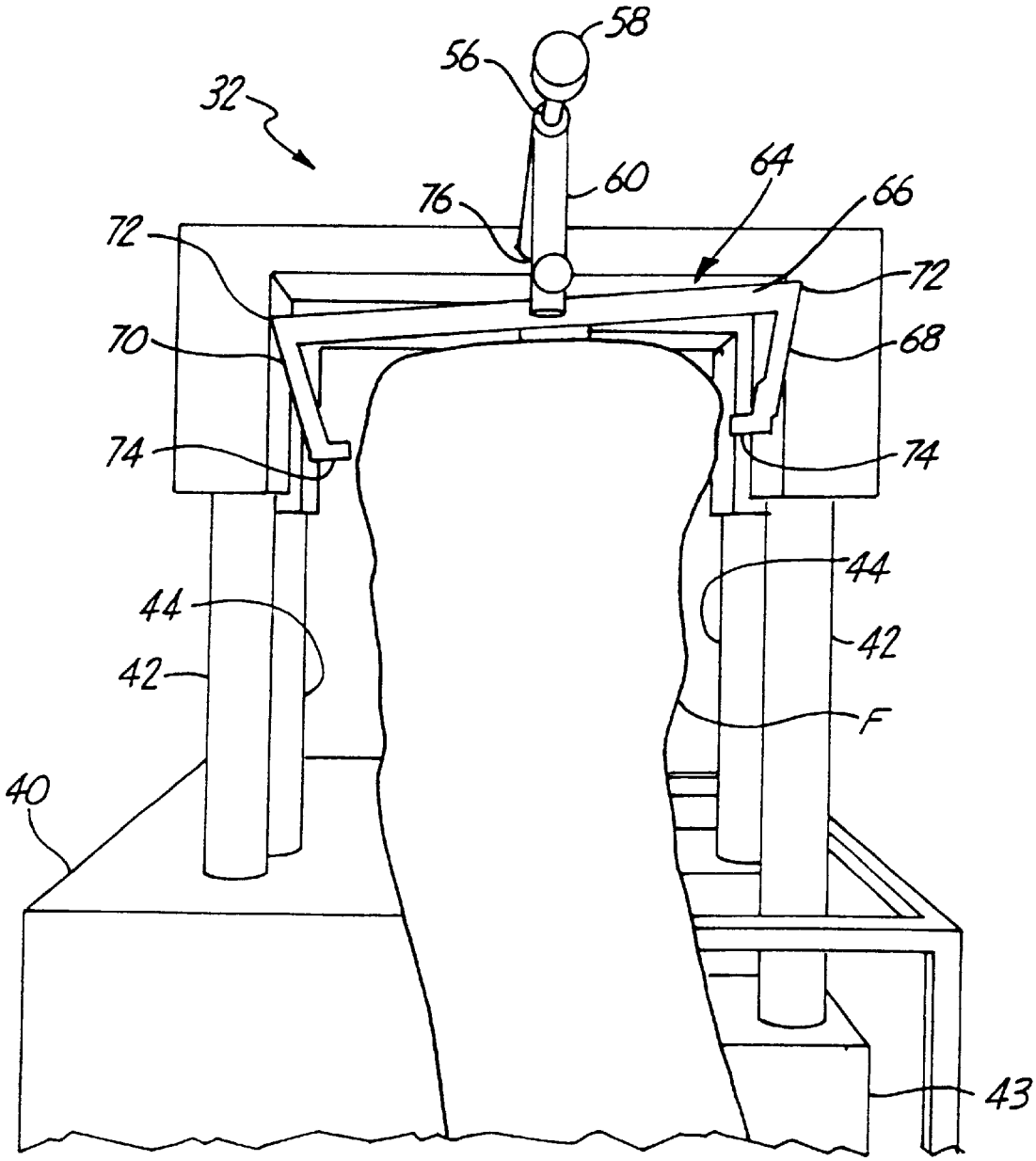
FIG. 4 is a rear view of the rearfoot and forefoot goniometer shown in FIG. 2.
Figure 5:
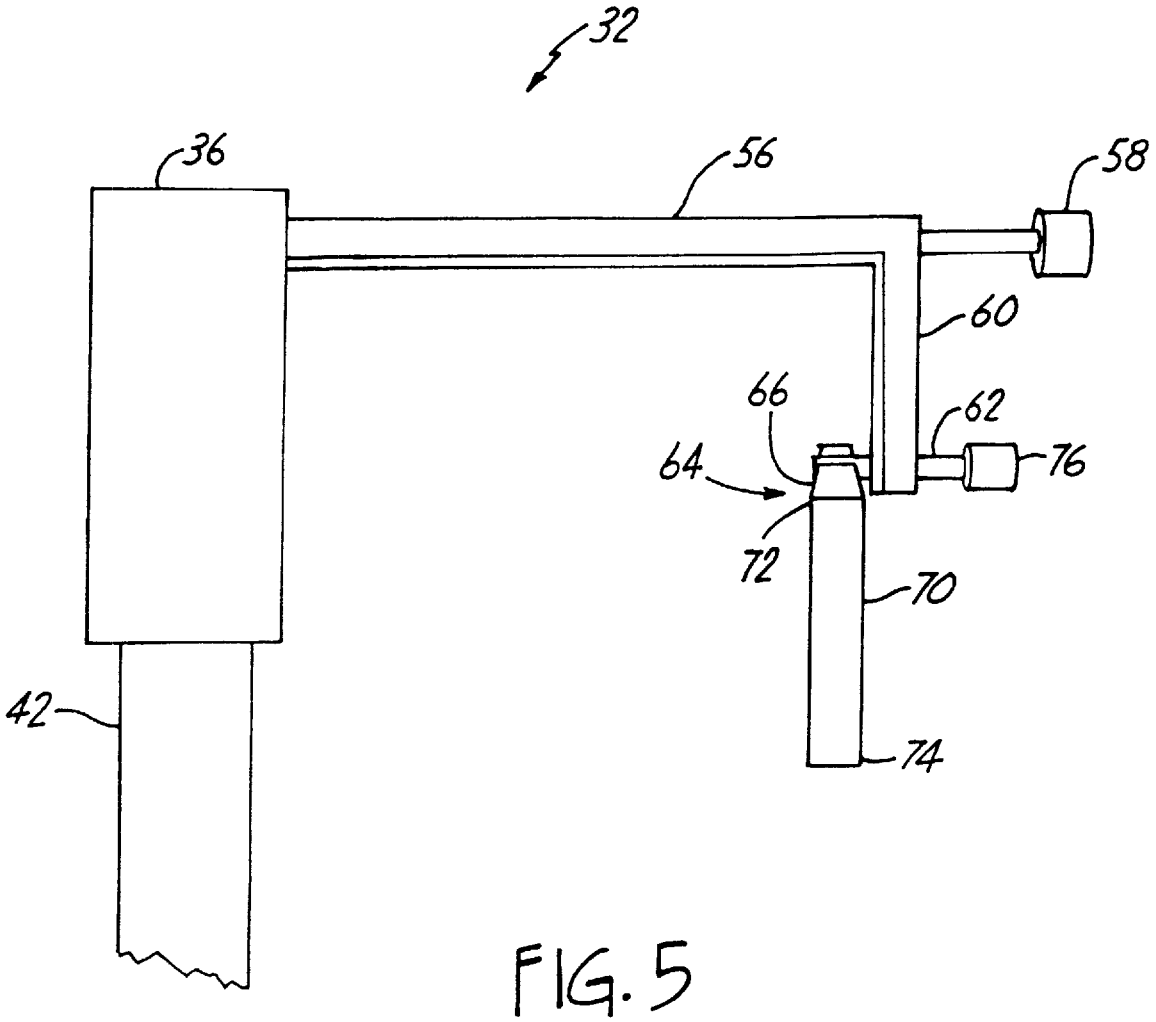
FIG. 5 is a side view of a portion of the rearfoot goniometer apparatus of the rearfoot and forefoot goniometer shown in FIG. 2.

As shown in FIG. 4, the calcaneal clamp 64 is secured to the lateral portion of the heel bone (calcaneus) of the foot F via the calcaneal attachment pads 74 attached to the ends of the clamp members 68 and 70, which are held in place by the spring-loaded compression joints 72. The knob 58 can be rotated to move the clamp 64 horizontally during the assessment process.

Figure 6:
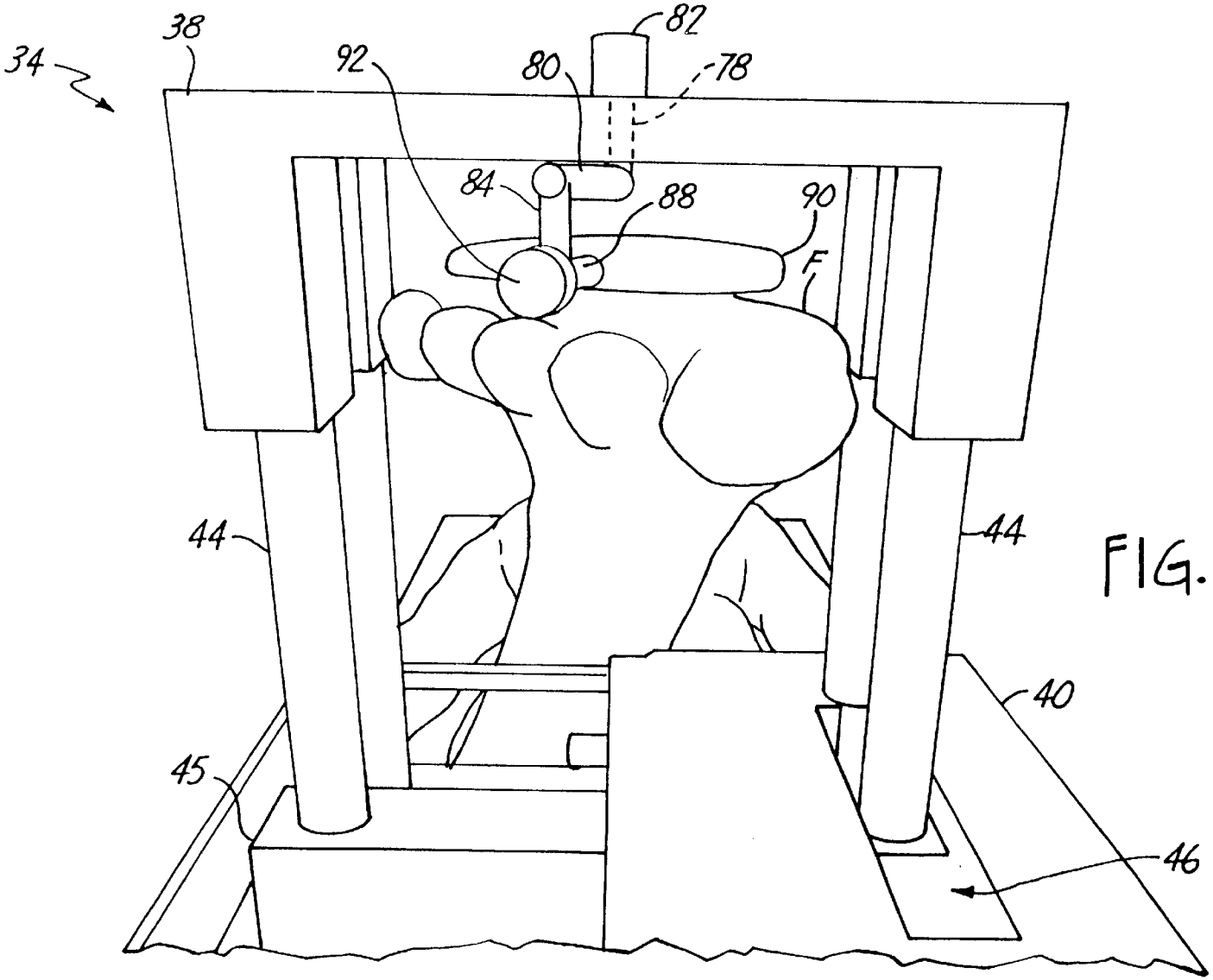
FIG. 6 is a front view of the rearfoot and forefoot goniometer shown in FIG. 2.
Figure 7:
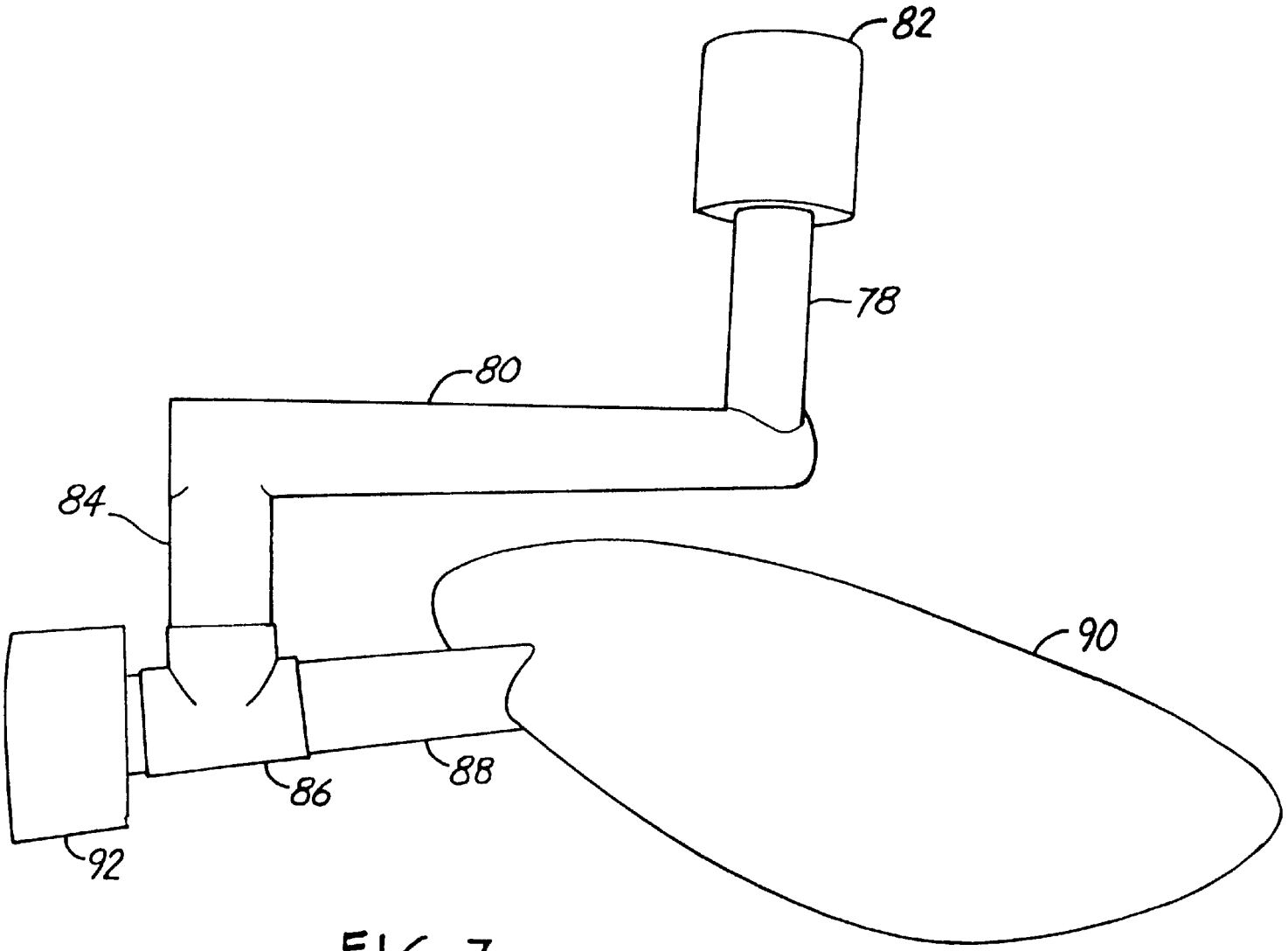
FIG. 7 is a side view of a portion of the forefoot goniometer apparatus of the rearfoot and forefoot goniometer shown in FIG. 2.
Figure 8:
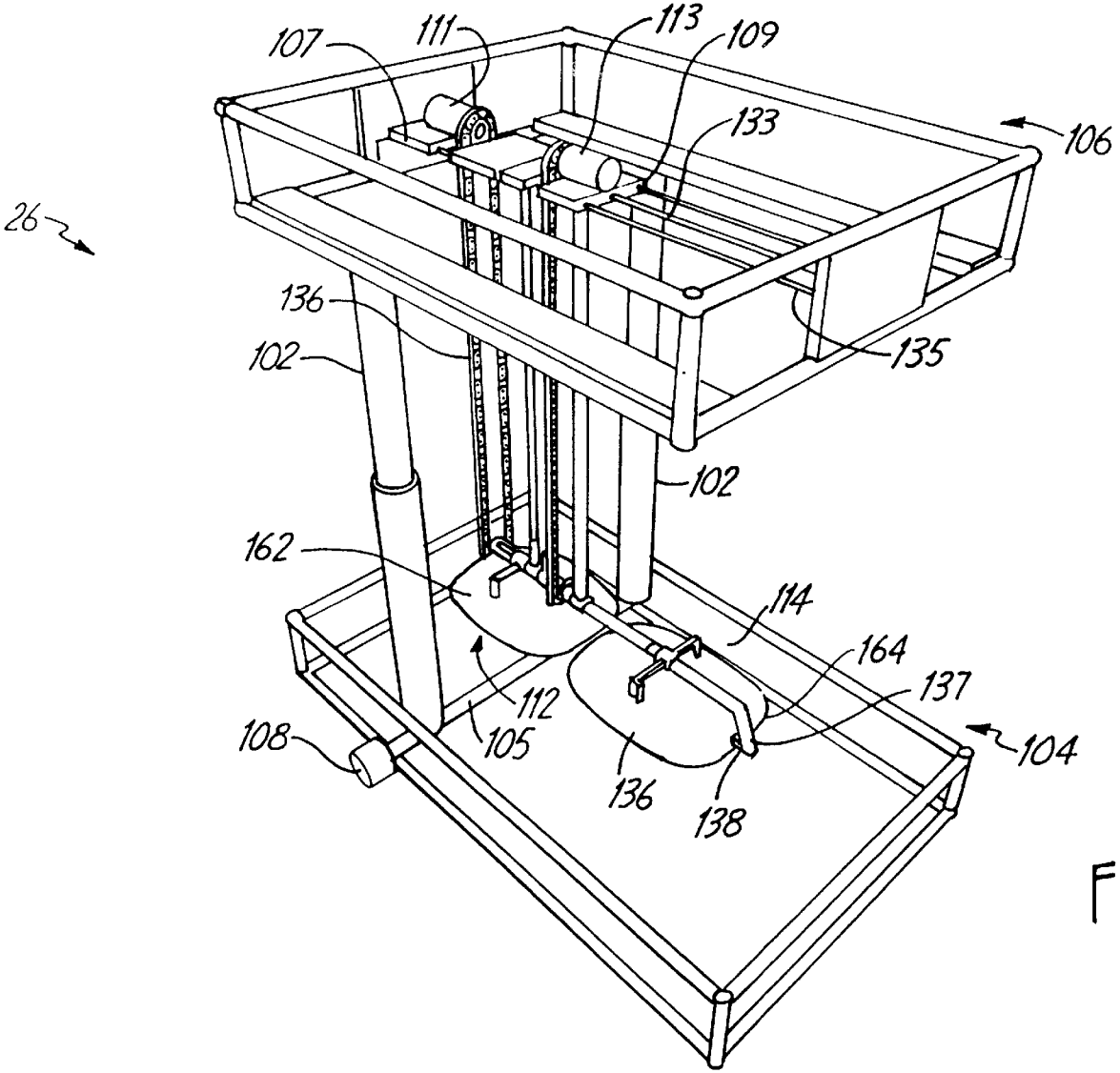
FIG. 8 is a perspective view of a shoe press according to the present invention with portions of the platform housing and servo control housing removed.

The forefoot assessment pad 90 is aligned, as shown in FIG. 6, with the heads of the metatarsal bones of the customer's foot F. This is accomplished by rotation of the RAF metatarsal alignment knob 82, which rotates the forefoot goniometer metatarsal alignment shaft 78 and the forefoot assessment pad 90 connected thereto. In this way, the forefoot assessment pad 90 is accurately aligned with the heads of the metatarsals (i.e., the ball of the foot). The forefoot assessment pad 90 is aligned with the bottom of the foot F by rotating the assessment pad 90 about the forefoot goniometer rotation shaft 88.

Once the rearfoot and forefoot goniometer apparatus 32 and 34 are correctly positioned, the technician will use both hands to manipulate the foot F into a position known as sub-talar neutral. Once in this position, the technician will trigger the collection of the rearfoot and forefoot alignment data from both the rearfoot and forefoot goniometers sensors 76 and 92 and storage of the rearfoot and forefoot alignment data in the computer 22. Collection can be triggered in any convenient manner, preferably by depressing a footswitch 24 (shown in FIG. 1) that is electrically connected to the computer 22. The program 400 running on the computer 22 visually displays the rearfoot and forefoot alignment data on the computer's monitor for qualitative evaluation of the rearfoot and forefoot alignment data. The program 400 then prompts the technician to indicate whether or not to store that information in the computer database. Once a satisfactory measurement has been taken and stored, the customer's foot can be removed from the RAF goniometer 12.

Figure 19:
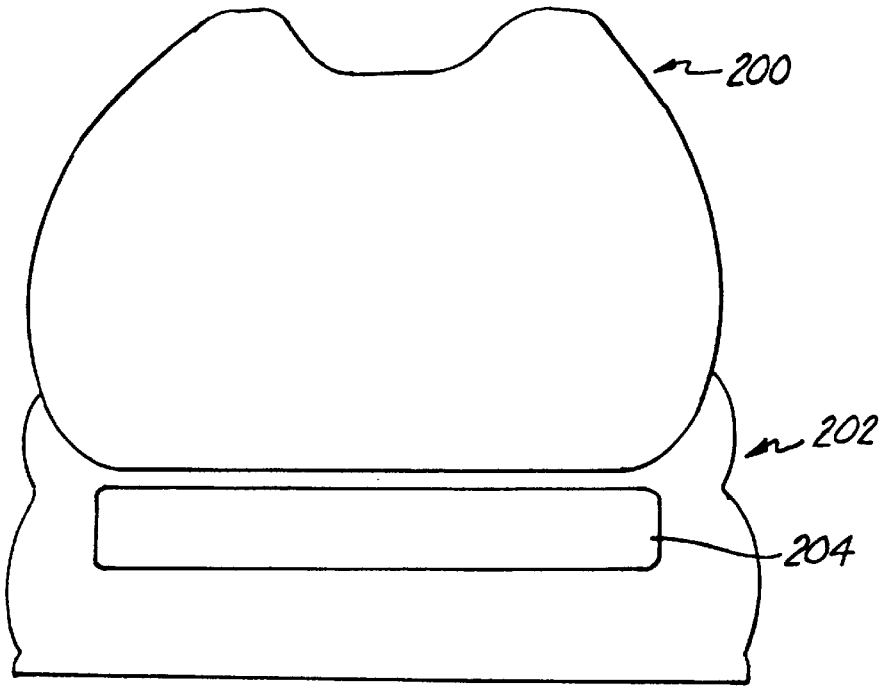
FIG. 19 is a rear schematic view of the customizable shoe of FIG. 15 prior to formation of a contour in the midsole thereof.
Figure 20:
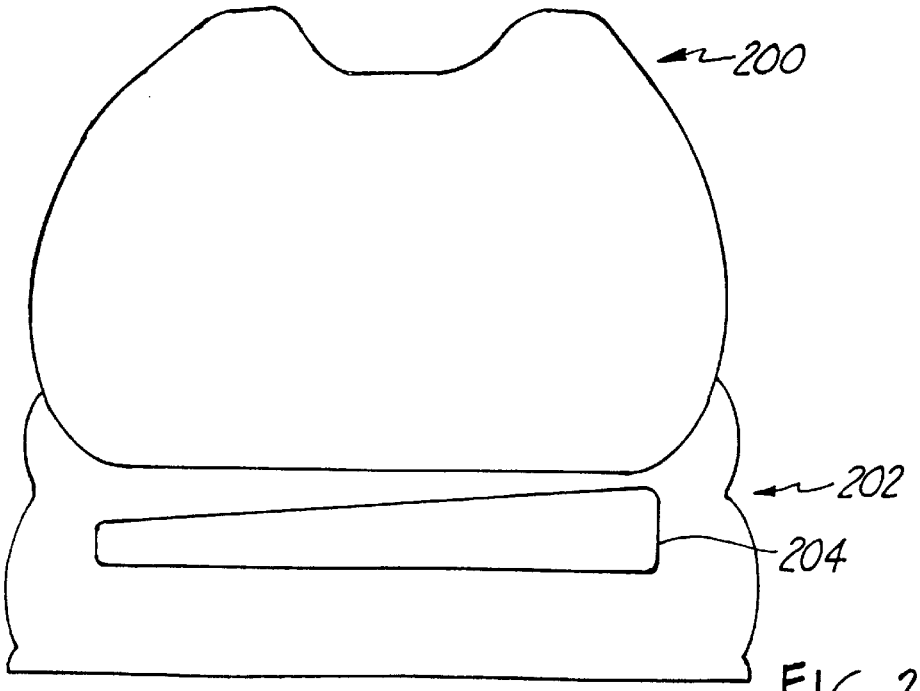
FIG. 20 is a rear schematic view of the customizable shoe of FIG. 15 after a contour has been formed and set in the midsole thereof.

A customizable shoe (or other piece of footwear having a moldable, settable midsole) is then provided and placed in the shoe press 26 for manipulation and customization. FIG. 19 is a rear view of a customizable shoe 200 of the type shown in FIG. 15 having a rearfoot bladder 204 prior to customization according to the present invention. The vertical position of the shoe press 26 is adjusted by rotating the height adjustment knob 108 in order to accommodate the insertion of the customizable shoe on the press pads 162 and 164. The height adjustment knob 108 is then rotated to lower the shoe and press pads 162 and 164 such that the sole of the customizable shoe is in contact with the upper surface of the outer cover of the support platform 104. Once the proper initial pressure is applied to the customizable shoe by the rearfoot and forefoot press pads 162 and 164, the technician will instruct the computer program 400 to send the rearfoot and forefoot alignment data to the rearfoot and forefoot servo motors 111 and 113. Rotation of the servo motors 111 and 113 will cause the rearfoot and forefoot drive chains 134 and 156, respectively, to move, which will in turn cause appropriate rotation of the rearfoot and forefoot rocker shafts 126 and 140, respectively. Rotation of the rocker shafts 126 and 140 will cause the rearfoot and forefoot press pads 162 and 164, respectively, to rotate independently about the rearfoot and forefoot horizontal support shafts 118 and 136, respectively, and thus apply pressure to the insole (above the midsole) of the customizable shoe. This pressure will result in a deformation of the rearfoot and forefoot bladders of the customizable shoe, which contain, for example, the aqueous isocynate solution or air (or other gas) as described above. Once the appropriate deformation (typically in the range of about 1 to about 9 millimeters) of the rearfoot and forefoot bladders is complete, the active ingredient or semi-rigid foam is injected through the appropriate injection ports of the shoe using the desired injection method and injection apparatus 28. The semi-rigid foam typically will be completely formed in less than one minute, thus causing the bladders to remain in a position that will provide a correction to the midsole of the shoe based on the alignment measurements taken from the RAF goniometer 12. This correction should place the customer's foot in a neutral position when the customer wears the customized shoes. FIG. 20 is a rear view of the customizable shoe 200 shown in FIG. 19 after customization according to the present invention by which a contour is formed in the rearfoot bladder 204.

Although the present invention has been described with reference to preferred embodiments, workers skilled in the art will recognize that changes may be made in form and detail without departing from the spirit and scope of the invention. For example, although FIGS. 1–20 show an embodiment of the present invention that can be used with a particular type of customizable shoe, it is to be understood that the present invention can be used with other types of footwear having a moldable, settable midsole and having any number (including zero) bladders.

What is claimed is:

1. A footwear customization process, comprising the steps of:

measuring alignment of a foot to provide alignment data;

providing a piece of footwear having a moldable, settable midsole;

applying pressure to the midsole based on the alignment data to form a contour in the midsole that provides alignment corrections based on the alignment data; and causing the midsole to set and retain the shape of the contour.

2. The footwear customization process of claim 1, wherein the measuring step comprises measuring rearfoot and forefoot alignment of the foot to provide rearfoot and forefoot alignment data.

3. The footwear customization process of claim 2, wherein the measuring step comprises measuring rearfoot and forefoot alignment of the foot while the foot is in a non-weight bearing position known as sub-talar neutral to provide the rearfoot and forefoot alignment data.

4. The footwear customization process of claim 1, further comprising the step of storing the alignment data in a computer database.

5. The footwear customization process of claim 1, wherein the midsole comprises a bladder containing a settable fluid and an injection port in fluid communication with the settable fluid, and wherein the setting step comprises injecting an additive through the injection port to set the settable fluid so that the midsole resiliently retains the shape of the contour after the pressure is removed.

6. The footwear customization process of claim 5, wherein the settable fluid is a polymer from the isocynate family of chemicals and the additive is selected from the group consisting of an amine and polyol.

7. The footwear customization process of claim 1, wherein the midsole comprises a bladder having an injection port and an exhaust valve, and wherein the setting step comprises injecting a settable fluid through the injection port and curing the settable fluid so that the midsole resiliently retains the shape of the contour after the pressure is removed.

8. The footwear customization process of claim 7, wherein the settable fluid is selected from the group consisting of polyurethane and EVA.

* * * * *